US007665192B2

(12) United States Patent
Blythe et al.

(10) Patent No.: US 7,665,192 B2
(45) Date of Patent: Feb. 23, 2010

(54) RECLOSABLE FASTENERS OR ZIPPERS FOR USE WITH POLYMERIC BAGS

(75) Inventors: James S. Blythe, Rochester, NY (US); David V. Dobreski, Fairport, NY (US); Daniel B. Ferrari, Rochester, NY (US); Steven P. Long, Canandaigua, NY (US); Toby R. Thomas, Victor, NY (US); David P. Cameron, Canandaigua, NY (US)

(73) Assignee: PACTiV Corporation, Lake Forest, IL (US)

( * ) Notice: Subject to any disclaimer, the term of this patent is extended or adjusted under 35 U.S.C. 154(b) by 0 days.

(21) Appl. No.: 12/079,019

(22) Filed: Mar. 24, 2008

(65) Prior Publication Data

US 2008/0172842 A1 Jul. 24, 2008

Related U.S. Application Data

(62) Division of application No. 11/644,508, filed on Dec. 22, 2006, now Pat. No. 7,377,015, which is a division of application No. 10/374,018, filed on Feb. 25, 2003, now Pat. No. 7,159,282.

(60) Provisional application No. 60/361,171, filed on Mar. 1, 2002.

(51) Int. Cl.
*A44B 19/16* (2006.01)
*B65D 33/16* (2006.01)

(52) U.S. Cl. ..... 24/400; 24/399; 24/30.5 R; 383/64

(58) Field of Classification Search ..... None
See application file for complete search history.

(56) References Cited

U.S. PATENT DOCUMENTS

| | | | |
|---|---|---|---|
| 1,785,234 | A | 12/1930 | Sundback |
| 2,091,617 | A | 8/1937 | Sundback |

(Continued)

FOREIGN PATENT DOCUMENTS

| | | | |
|---|---|---|---|
| EP | 0 239 319 | A2 | 3/1987 |
| EP | 0 371 402 | A2 | 6/1990 |
| FR | 2 636 923 | A3 | 9/1989 |

(Continued)

OTHER PUBLICATIONS

PCT Search Report for International Application No. PCT/US03/06050 dated Jun. 4, 2004 (4 pages).

*Primary Examiner*—Robert J Sandy
(74) *Attorney, Agent, or Firm*—Nixon Peabody LLP

(57) ABSTRACT

A slider is adapted for use with a reclosable fastener for bags containing material. The reclosable fastener includes a first track and a second track. The first track includes a first profile, while the second track includes a second profile. The first and second profiles are releasably engageable to each other. At least one of the first and second profiles has an interior portion. The slider comprises a body that includes a top, a first side, a second side and a separation member on an underside of the top. The separation member is adapted to open and close the fastener and includes a slider finger that extends generally downwardly from the top. The slider finger extends into an interior portion of the first profile so as to assist in removing material trapped in the interior portion of the first profile when closing the reclosable fastener.

21 Claims, 19 Drawing Sheets

U.S. PATENT DOCUMENTS

| | | | | |
|---|---|---|---|---|
| 2,440,012 | A | 4/1948 | Haver | |
| 2,652,611 | A | 9/1953 | Jaster | |
| 2,736,079 | A | 2/1956 | Stallet et al. | |
| 2,772,712 | A | 12/1956 | Post | |
| 2,779,385 | A | 1/1957 | Carlzen et al. | |
| 2,978,769 | A | 4/1961 | Harrah | |
| 3,074,137 | A | 1/1963 | Hawley | |
| 3,149,927 | A | 9/1964 | Fady | |
| 3,172,443 | A | 3/1965 | Ausnit | |
| 3,181,583 | A | 5/1965 | Lingenfelter | |
| 3,198,228 | A | 8/1965 | Naito | |
| 3,225,429 | A | 12/1965 | Fady | |
| 3,259,951 | A | 7/1966 | Zimmerman | |
| 3,381,592 | A | 5/1968 | Ravel | |
| 3,426,396 | A | 2/1969 | LaGuerre | |
| 3,473,589 | A | 10/1969 | Gotz | |
| 3,532,571 | A | 10/1970 | Ausnit | |
| 3,579,747 | A | 5/1971 | Hawley | 24/201 |
| RE27,174 | E | 9/1971 | Ausnit | |
| 3,608,439 | A | 9/1971 | Ausnit | |
| 3,613,524 | A | 10/1971 | Behr | 93/33 R |
| 3,633,642 | A | 1/1972 | Siegel | 150/3 |
| 3,644,981 | A | 2/1972 | Gustavsson | 29/207.5 SL |
| 3,701,191 | A | 10/1972 | Laguerre | 29/207.5 SL |
| 3,701,192 | A | 10/1972 | Laguerre | 29/207.5 SL |
| 3,746,215 | A | 7/1973 | Ausnit et al. | 222/92 |
| 3,780,781 | A | 12/1973 | Uramoto | 150/3 |
| 3,785,111 | A | 1/1974 | Pike | 53/14 |
| 3,790,992 | A | 2/1974 | Herz | 24/201 C |
| 3,849,843 | A | 11/1974 | Alberts | 24/205.12 |
| 3,948,705 | A | 4/1976 | Ausnit | 156/73.4 |
| 3,962,007 | A | 6/1976 | Heimberger | 156/73.1 |
| 3,991,801 | A | 11/1976 | Ausnit | 150/3 |
| 4,094,729 | A | 6/1978 | Boccia | 156/515 |
| 4,101,355 | A | 7/1978 | Ausnit | 156/66 |
| 4,122,594 | A | 10/1978 | Azzara | 29/408 |
| 4,173,283 | A | 11/1979 | Takamatsu | 206/338 |
| 4,191,230 | A | 3/1980 | Ausnit | 150/3 |
| 4,196,030 | A | 4/1980 | Ausnit | 156/91 |
| 4,232,429 | A | 11/1980 | Friedberg | 24/205.11 |
| 4,235,653 | A | 11/1980 | Ausnit | 156/91 |
| 4,240,241 | A | 12/1980 | Sanborn, Jr. | 53/412 |
| 4,241,865 | A | 12/1980 | Ferrell | 229/62 |
| 4,249,982 | A | 2/1981 | Ausnit | 156/461 |
| 4,262,395 | A | 4/1981 | Kosky | 24/201 C |
| 4,277,241 | A | 7/1981 | Schulze | 493/196 |
| 4,285,376 | A | 8/1981 | Ausnit | 150/3 |
| 4,355,494 | A | 10/1982 | Tilman | 53/416 |
| 4,410,130 | A | 10/1983 | Herrington | 383/62 |
| 4,415,386 | A | 11/1983 | Ferrell et al. | 156/64 |
| 4,419,159 | A | 12/1983 | Herrington | 156/66 |
| RE31,487 | E | 1/1984 | Friedberg | 24/386 |
| 4,430,070 | A | 2/1984 | Ausnit | 493/215 |
| 4,437,293 | A | 3/1984 | Sanborn, Jr. | 53/412 |
| 4,528,224 | A | 7/1985 | Ausnit | 428/36 |
| 4,532,652 | A | 7/1985 | Herrington | 383/103 |
| 4,561,108 | A | 12/1985 | Kamp | 383/63 |
| 4,561,109 | A | 12/1985 | Herrington | 383/65 |
| 4,581,006 | A | 4/1986 | Hugues et al. | 493/213 |
| 4,582,549 | A | 4/1986 | Ferrell | 156/66 |
| 4,601,694 | A | 7/1986 | Ausnit | 493/381 |
| 4,617,683 | A | 10/1986 | Christoff | 383/63 |
| 4,618,383 | A | 10/1986 | Herrington | 156/66 |
| 4,620,320 | A | 10/1986 | Sullivan | 383/79 |
| 4,651,504 | A | 3/1987 | Bentsen | 53/452 |
| 4,655,862 | A | 4/1987 | Christoff et al. | 156/66 |
| 4,663,915 | A | 5/1987 | Van Erden et al. | 53/450 |
| 4,666,536 | A | 5/1987 | Van Erden et al. | 156/64 |
| 4,673,383 | A | 6/1987 | Bentsen | 493/381 |
| 4,691,372 | A | 9/1987 | Van Erden | 383/63 |
| 4,703,518 | A | 10/1987 | Ausnit | 383/63 |
| 4,709,533 | A | 12/1987 | Ausnit | 383/63 |
| 4,736,450 | A | 4/1988 | Van Erden et al. | 383/65 |
| 4,744,674 | A | 5/1988 | Nocek | 383/63 |
| 4,782,951 | A | 11/1988 | Griesbach et al. | 206/484 |
| 4,787,880 | A | 11/1988 | Ausnit | 493/213 |
| 4,791,710 | A | 12/1988 | Nocek et al. | 24/587 |
| 4,792,240 | A | 12/1988 | Ausnit | 383/63 |
| 4,807,300 | A | 2/1989 | Ausnit et al. | 383/65 |
| 4,812,074 | A | 3/1989 | Ausnit et al. | 493/213 |
| 4,832,505 | A | 5/1989 | Ausnit et al. | 383/5 |
| 4,840,611 | A | 6/1989 | Van Erden et al. | 493/213 |
| 4,844,759 | A | 7/1989 | Boeckmann | 156/66 |
| 4,846,585 | A | 7/1989 | Boeckmann et al. | 383/5 |
| 4,850,178 | A | 7/1989 | Ausnit | 53/570 |
| 4,876,842 | A | 10/1989 | Ausnit | 53/410 |
| 4,877,336 | A | 10/1989 | Peppiatt | 383/8 |
| 4,891,867 | A | 1/1990 | Takeshima et al. | 24/408 |
| 4,892,414 | A | 1/1990 | Ausnit | 383/63 |
| 4,892,512 | A | 1/1990 | Branson | 493/194 |
| 4,894,975 | A | 1/1990 | Ausnit | 53/412 |
| 4,909,017 | A | 3/1990 | McMahon et al. | 53/410 |
| 4,923,309 | A | 5/1990 | VanErden | 383/5 |
| 4,925,316 | A | 5/1990 | Van Erden et al. | 383/61 |
| 4,925,318 | A | 5/1990 | Sorensen | 383/63 |
| 4,929,225 | A | 5/1990 | Ausnit et al. | 493/213 |
| 4,941,307 | A | 7/1990 | Wojcik | 53/412 |
| 4,947,525 | A | 8/1990 | Van Erden | 24/304 |
| 4,949,527 | A | 8/1990 | Boeckmann et al. | 53/412 |
| 4,974,395 | A | 12/1990 | McMahon | 53/551 |
| 4,987,658 | A | 1/1991 | Horita | 24/403 |
| 5,004,356 | A | 4/1991 | Matsui | 383/63 |
| 5,007,142 | A | 4/1991 | Herrington | 24/400 |
| 5,007,143 | A | 4/1991 | Herrington | 24/400 |
| 5,007,146 | A | 4/1991 | Meidan | 24/683 |
| 5,010,627 | A | 4/1991 | Herrington et al. | 24/400 |
| 5,017,021 | A | 5/1991 | Simonsen et al. | 383/63 |
| 5,020,194 | A | 6/1991 | Herrington et al. | 24/400 |
| 5,023,122 | A | 6/1991 | Boeckmann et al. | 428/43 |
| RE33,674 | E | 8/1991 | Uramoto | 206/620 |
| 5,036,643 | A | 8/1991 | Bodolay | 53/128.1 |
| 5,063,069 | A | 11/1991 | Van Erden et al. | 426/122 |
| 5,063,639 | A | 11/1991 | Boeckmann et al. | 24/30.5 R |
| 5,063,644 | A | 11/1991 | Herrington et al. | 24/400 |
| 5,067,208 | A | 11/1991 | Herrington, Jr. et al. | 24/400 |
| 5,067,822 | A | 11/1991 | Wirth et al. | 383/61 |
| 5,070,583 | A | 12/1991 | Herrington | 24/400 |
| 5,085,031 | A | 2/1992 | McDonald | 53/412 |
| 5,088,971 | A | 2/1992 | Herrington | 493/203 |
| 5,092,684 | A | 3/1992 | Weeks | 383/61 |
| 5,092,831 | A | 3/1992 | James et al. | 493/394 |
| 5,096,516 | A | 3/1992 | McDonald et al. | 156/66 |
| 5,100,246 | A | 3/1992 | La Pierre et al. | 383/204 |
| 5,111,643 | A | 5/1992 | Hobock | 53/551 |
| 5,116,301 | A | 5/1992 | Robinson et al. | 493/215 |
| 5,121,997 | A | 6/1992 | LaPierre et al. | 383/203 |
| 5,127,208 | A | 7/1992 | Custer et al. | 53/412 |
| 5,129,734 | A | 7/1992 | Van Erden | 383/61 |
| 5,131,121 | A | 7/1992 | Herrington, Jr. et al. | 24/436 |
| 5,161,286 | A | 11/1992 | Herrington, Jr. et al. | 24/387 |
| 5,167,608 | A | 12/1992 | Steffens, Jr. et al. | 493/214 |
| 5,185,909 | A | 2/1993 | Inagaki | 24/587 |
| 5,186,543 | A | 2/1993 | Cochran | 383/203 |
| 5,188,461 | A | 2/1993 | Sorensen | 383/63 |
| 5,189,764 | A | 3/1993 | Herrington et al. | 24/387 |
| 5,198,055 | A | 3/1993 | Wirth et al. | 156/66 |
| 5,211,482 | A | 5/1993 | Tilman | 383/202 |
| 5,224,779 | A | 7/1993 | Thompson et al. | 383/5 |
| 5,238,306 | A | 8/1993 | Heintz et al. | 383/61 |
| 5,273,511 | A | 12/1993 | Boeckman | 493/195 |
| 5,283,932 | A | 2/1994 | Richardson et al. | 24/400 |
| RE34,554 | E | 3/1994 | Ausnit | 383/63 |
| 5,293,672 | A | 3/1994 | Tominaga et al. | 24/587 |
| 5,301,394 | A | 4/1994 | Richardson et al. | 24/399 |

| | | | | |
|---|---|---|---|---|
| 5,301,395 | A | 4/1994 | Richardson et al. | 24/400 |
| 5,322,579 | A | 6/1994 | Van Erden | 156/66 |
| 5,330,269 | A | 7/1994 | Kamada et al. | 383/210 |
| 5,334,127 | A | 8/1994 | Bruno et al. | 493/194 |
| 5,383,989 | A | 1/1995 | McMahon | 156/66 |
| 5,391,136 | A | 2/1995 | Makowka | 493/210 |
| 5,400,565 | A | 3/1995 | Terminella et al. | 53/133.4 |
| 5,400,568 | A | 3/1995 | Kanemitsu et al. | 53/412 |
| RE34,905 | E | 4/1995 | Ausnit | 53/412 |
| 5,403,094 | A | 4/1995 | Tomic | 383/63 |
| 5,405,478 | A | 4/1995 | Richardson et al. | 156/308.4 |
| 5,405,629 | A | 4/1995 | Marnocha et al. | 426/122 |
| 5,412,924 | A | 5/1995 | Ausnit | 53/412 |
| 5,415,904 | A | 5/1995 | Takubo et al. | 428/35.2 |
| 5,425,216 | A | 6/1995 | Ausnit | 53/410 |
| 5,425,825 | A | 6/1995 | Rasko et al. | 156/66 |
| 5,426,830 | A | 6/1995 | Richardson et al. | 24/430 |
| 5,431,760 | A | 7/1995 | Donovan | 156/66 |
| 5,435,864 | A | 7/1995 | Machacek et al. | 156/66 |
| 5,442,837 | A | 8/1995 | Morgan | 24/400 |
| 5,442,838 | A | 8/1995 | Richardson et al. | 24/402 |
| 5,448,808 | A | 9/1995 | Gross | 24/400 |
| 5,456,928 | A | 10/1995 | Hustad et al. | 426/87 |
| 5,461,845 | A | 10/1995 | Yeager | 53/451 |
| 5,470,156 | A | 11/1995 | May | 383/210 |
| 5,482,375 | A | 1/1996 | Richardson et al. | 383/64 |
| 5,486,051 | A | 1/1996 | May | 383/200 |
| 5,489,252 | A | 2/1996 | May | 383/210 |
| 5,492,411 | A | 2/1996 | May | 383/5 |
| 5,505,037 | A | 4/1996 | Terminella et al. | 53/133.4 |
| 5,509,735 | A | 4/1996 | May | 383/210 |
| 5,511,884 | A | 4/1996 | Bruno et al. | 383/63 |
| 5,513,915 | A | 5/1996 | May | 383/210 |
| 5,519,982 | A | 5/1996 | Herber et al. | 53/412 |
| 5,525,363 | A | 6/1996 | Herber et al. | 426/130 |
| 5,529,394 | A | 6/1996 | Davoren | 383/61 |
| 5,542,902 | A | 8/1996 | Richison et al. | 493/195 |
| 5,551,127 | A | 9/1996 | May | 20/30.5 R |
| 5,551,208 | A | 9/1996 | Van Erden | 53/139.2 |
| 5,552,202 | A | 9/1996 | May | 428/43 |
| 5,557,907 | A | 9/1996 | Malin et al. | 53/139.2 |
| 5,558,613 | A | 9/1996 | Tilman et al. | 493/214 |
| 5,561,966 | A | 10/1996 | English | 53/412 |
| 5,564,259 | A | 10/1996 | Stolmeier | 53/410 |
| 5,573,614 | A | 11/1996 | Tilman et al. | 156/66 |
| 5,582,853 | A | 12/1996 | Marnocha et al. | 426/122 |
| 5,592,802 | A | 1/1997 | Malin et al. | 53/133.4 |
| 5,613,934 | A | 3/1997 | May | 493/214 |
| 5,628,566 | A | 5/1997 | Schreiter | 383/63 |
| 5,645,905 | A | 7/1997 | Takubo et al. | 428/35.7 |
| 5,647,671 | A | 7/1997 | May | 383/210 |
| 5,664,296 | A | 9/1997 | May | 24/30.5 R |
| 5,664,299 | A | 9/1997 | Porchia et al. | 24/400 |
| 5,669,715 | A | 9/1997 | Dobreski et al. | 383/5 |
| 5,681,115 | A | 10/1997 | Diederich et al. | 383/64 |
| 5,689,866 | A | 11/1997 | Kasai et al. | 24/587 |
| 5,713,110 | A | 2/1998 | Covi et al. | 24/431 |
| 5,713,669 | A | 2/1998 | Thomas et al. | 383/204 |
| 5,722,128 | A | 3/1998 | Toney et al. | 24/400 |
| 5,725,312 | A | 3/1998 | May | 383/210 |
| 5,769,772 | A | 6/1998 | Wiley | 493/189 |
| 5,775,812 | A | 7/1998 | St. Phillips et al. | 383/5 |
| 5,782,733 | A | 7/1998 | Yeager | 493/213 |
| 5,788,378 | A | 8/1998 | Thomas | 383/63 |
| 5,823,933 | A | 10/1998 | Yeager | 493/213 |
| 5,833,791 | A | 11/1998 | Bryniarski et al. | 156/244.25 |
| 5,851,070 | A | 12/1998 | Dobreski et al. | 383/63 |
| 5,867,875 | A | 2/1999 | Beck et al. | 24/400 |
| 5,871,281 | A | 2/1999 | Stolmeier et al. | 383/64 |
| 5,875,611 | A | 3/1999 | Plourde | 53/412 |
| 5,896,627 | A | 4/1999 | Cappel et al. | 24/400 |
| 5,906,438 | A | 5/1999 | Laudenberg | 383/63 |
| 5,911,508 | A | 6/1999 | Dobreski et al. | 383/5 |
| 5,919,535 | A | 7/1999 | Dobreski et al. | 428/35.2 |
| 5,924,173 | A | 7/1999 | Dobreski et al. | 24/400 |
| 5,956,924 | A | 9/1999 | Thieman | 53/412 |
| 5,964,532 | A | 10/1999 | St. Phillips et al. | 383/5 |
| 5,983,466 | A | 11/1999 | Petkovsek | 24/400 |
| 6,009,603 | A | 1/2000 | Gallagher | 24/587 |
| 6,010,244 | A | 1/2000 | Dobreski et al. | 383/63 |
| 6,047,450 | A | 4/2000 | Machacek et al. | 24/399 |
| 6,178,722 | B1 | 1/2001 | McMahon | 53/412 |
| 6,257,763 | B1 | 7/2001 | Stolmeier et al. | 383/5 |
| 6,286,189 | B1 | 9/2001 | Provan et al. | 24/30.5 R |
| 6,286,999 | B1 | 9/2001 | Cappel et al. | 383/5 |
| 6,289,561 | B1 | 9/2001 | Provan et al. | 24/415 |
| 6,292,986 | B1 | 9/2001 | Provan et al. | 24/415 |
| 6,299,353 | B1 | 10/2001 | Piechocki et al. | 383/63 |
| 6,327,754 | B1 | 12/2001 | Belmont et al. | 24/400 |
| 6,524,002 | B2 | 2/2003 | Tomic | 383/64 |
| 6,526,632 | B1 | 3/2003 | Blythe et al. | 24/400 |
| 6,527,444 | B1 | 3/2003 | Buchman | 383/36 |
| 6,611,996 | B2 | 9/2003 | Blythe et al. | 24/399 |
| 6,739,755 | B2 | 5/2004 | Schreiter | 383/64 |
| 2002/0154837 | A1 | 10/2002 | Ausnit | 383/64 |
| 2003/0077009 | A1 | 4/2003 | Schreiter | 383/64 |
| 2003/0169949 | A1 | 9/2003 | Buchman | 383/64 |

FOREIGN PATENT DOCUMENTS

| | | |
|---|---|---|
| GB | 522663 | 6/1940 |
| GB | 2 085 519 | 10/1980 |
| GB | 2 138 494 | 3/1983 |
| GB | 2 258 010 A | 1/1993 |
| WO | WO 91/13759 | 9/1991 |
| WO | WO 95/29604 | 11/1995 |
| WO | WO 95/35046 | 12/1995 |
| WO | WO 95/35047 | 12/1995 |
| WO | WO 95/35048 | 12/1995 |

RECLOSABLE FASTENERS OR ZIPPERS FOR USE WITH POLYMERIC BAGS

RELATED APPLICATIONS

This application is a divisional of U.S. patent application Ser. No. 11/644,508 filed on Dec. 22, 2006 now U.S. Pat. No. 7,377,015 and which has been allowed; application Ser. No. 11/644,508 is a divisional of U.S. patent application Ser. No. 10/374,018, entitled "Reclosable Fasteners Or Zippers For Use With Polymeric Bags," which was filed on Feb. 25, 2003 and issued as U.S. Pat. No. 7,159,282, and which claims the benefit of U.S. Provisional Application Ser. No. 60/361,171 filed on Mar. 1, 2002 and is entitled "Reclosable Fasteners Or Zippers For Use With Polymeric Bags" all of which are hereby incorporated by reference herein in their entirety.

FIELD OF THE INVENTION

The present invention relates generally to reclosable polymeric bags. More particularly, the present invention relates to improved fasteners or zippers for use with the polymeric bags.

BACKGROUND OF THE INVENTION

Polymeric bags are popular household items that are used in a variety of applications including storage of food. The addition of reclosable fasteners or zippers to these bags has further enhanced their utility and the addition of a slider has made the fasteners easier to open and close. The fasteners include complementary first and second profiles that engage each other to close the polymeric bag.

There are a variety of food items that are desirable to store in these polymeric bags. Some desired items for storage include packaged material, such as particles or powders. This packaged material may include such items as sugar, salt, baby formula, coffee, pancake mix and dog food. Existing reclosable fastener or zipper bags, such as press to close bags and slider bags, often do not reclose after the packaged material is poured from the bag because the material gets trapped in an interior area of one or more of the profiles. The trapped material can prevent or inhibit the first and second profiles from rolling or snapping together, resulting in the fastener not being able to reclose.

A need therefore exists for an improved reclosable fastener that reduces or eliminates the above-described problem of reclosing the first and second profiles after packaged material has been trapped therein.

SUMMARY OF THE INVENTION

According to one embodiment, a slider is adapted for use with a reclosable fastener for bags containing material. The reclosable fastener includes a first track and a second track. The first track includes a first profile, while the second track includes a second profile. The first and second profiles are releasably engageable to each other. At least one of the first and second profiles has an interior portion. The slider comprises a body that includes a top, a first side, a second side and a separation member on an underside of the top. The separation member is adapted to open and close the fastener and includes a first slider finger and a second slider finger. The first slider finger extends generally downwardly from the top. The first slider finger extends into an interior portion of the first profile so as to assist in removing material trapped in the interior portion of the first profile when closing the reclosable fastener. The second slider finger extends generally downwardly from the top. The second slider finger extends into an interior portion of the second profile so as to assist in removing material trapped in the interior portion of the second profile when closing the reclosable fastener.

According to one embodiment, a reclosable fastener is adapted for use with bags having an interior space adapted to receive material. The reclosable fastener comprises a first track and a second track. The first track includes a first profile, first fin portion and a first fin flap. The second track includes a second profile, a second fin portion and a second fin flap. The first and second profiles are releasably engageable to each other. The first fin portion extends generally downwardly from the first profile toward the interior space of the bag. The second fin portion extends generally downwardly from the second profile toward the interior space of the bag. The first fin flap is attached to the first fin and extends upwardly and outwardly to the second profile so as to prevent or inhibit material from entering one of more interior areas of the first and second profiles. The second fin flap is attached to the second fin portion and extends upwardly and outwardly to the first profile so as to prevent or inhibit material from entering one of more interior areas of the first and second profiles.

According to another embodiment, a reclosable fastener is adapted for use with bags having an interior space adapted to receive material. The reclosable fastener comprises a first track and a second track. The first track includes a first profile, and a first fin portion. The second track includes a second profile, a second fin portion and a first fin flap. The first and second profiles are releasably engageable to each other. The first fin portion extends generally downwardly from the first profile toward the interior space of the bag. The second fin portion extends generally downwardly from the second profile toward the interior space of the bag. The first fin flap is attached to the second fin portion and extends upwardly and outwardly to the first profile so as to prevent or inhibit material from entering one of more interior areas of the first and second profiles.

According to a further embodiment, a reclosable fastener is adapted for use with bags having an interior space adapted to receive material. The reclosable fastener comprises a first track and a second track. The first track includes a first profile that has an interior area, while the second track includes a second profile. The first and second profiles are releasably engageable to each other. The first profile has a thin walled deflection shield that prevents or inhibits material from entering the interior area of the first profile. A portion of the thin walled deflection shield is adapted to break, rupture or slit in response to a portion of the second profile entering the interior area of the first profile. The thin walled deflection shield may be formed by a seam portion.

According to yet another embodiment, a reclosable fastener is adapted for use with bags having an interior space adapted to receive material. The reclosable fastener comprises a first track and a second track. The first track includes a first profile, while the second track includes a second profile. The first and second profiles are releasably engageable to each other. The first profile is a general c-shape and further includes two thin walled deflection shields. The general c-shape is formed from two extensions spaced apart and attached to a first portion. The two extensions has two outer ends spaced from the first portion. Each of the two thin walled deflection shields is attached near a respective one of the two outer ends of the two extensions so as to prevent or inhibit material from entering the interior area of the first profile. The thin walled deflection shields are spaced slightly apart so as to allow a portion of the second profile to enter into the interior area formed by the general c-shape section.

According to yet a further embodiment, a reclosable fastener is adapted for use with bags having an interior space adapted to receive material. The reclosable fastener comprises a first track and a second track. The first track includes a first profile, while the second track includes a second profile. The first profile includes a gasket formed in an interior area thereof. The gasket is adapted to prevent or inhibit material from entering the interior area of the first profile and/or expel material from the interior area of the first profile. The first and second profiles are releasably engageable to each other and the gasket is compressed upon engagement of the first and second profiles.

Figure 1:
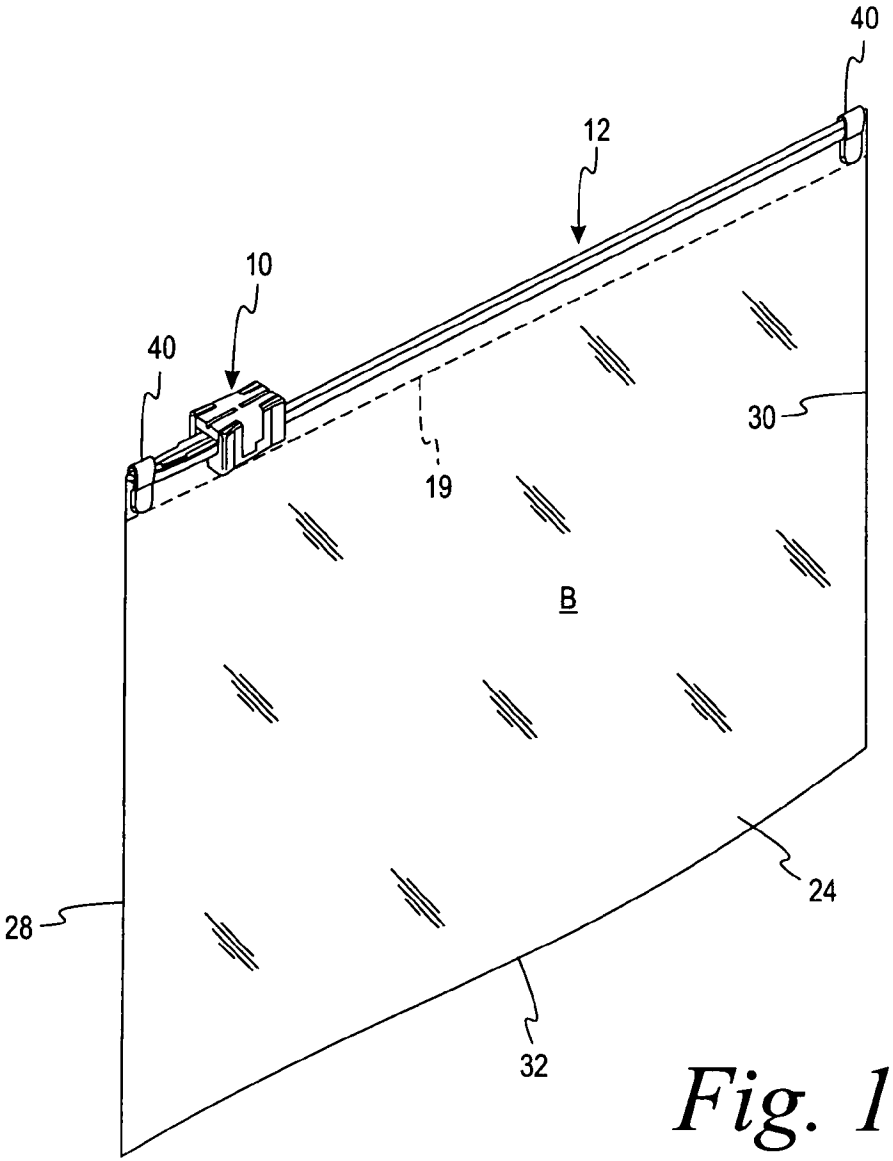
FIG. 1 is a perspective view of a thermoplastic bag having a fastener and slider.

While the invention is susceptible to various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents, and alternatives falling within the spirit and scope of the invention as defined by the appended claims.

DETAILED DESCRIPTION OF THE ILLUSTRATED EMBODIMENT

Referring to FIG. 1, there is illustrated a polymeric slider 10 and a profiled polymeric fastener or zipper 12. The slider 10 and fastener 12 are particularly suited for thermoplastic bags and the like. It is contemplated that the slider and fastener may be used with other bags such as multi-walled paper bags. Slider 10 has been illustrated in FIG. 2 assembled on the fastener 12 at the top edge or mouth of a thermoplastic bag B. The slider 10 and the fastener 12 cooperate to close the bag B. To assist in opening the bag, the slider 10 is slidably mounted to the fastener 12 for movement between a closed position and an open position.

Figure 2:
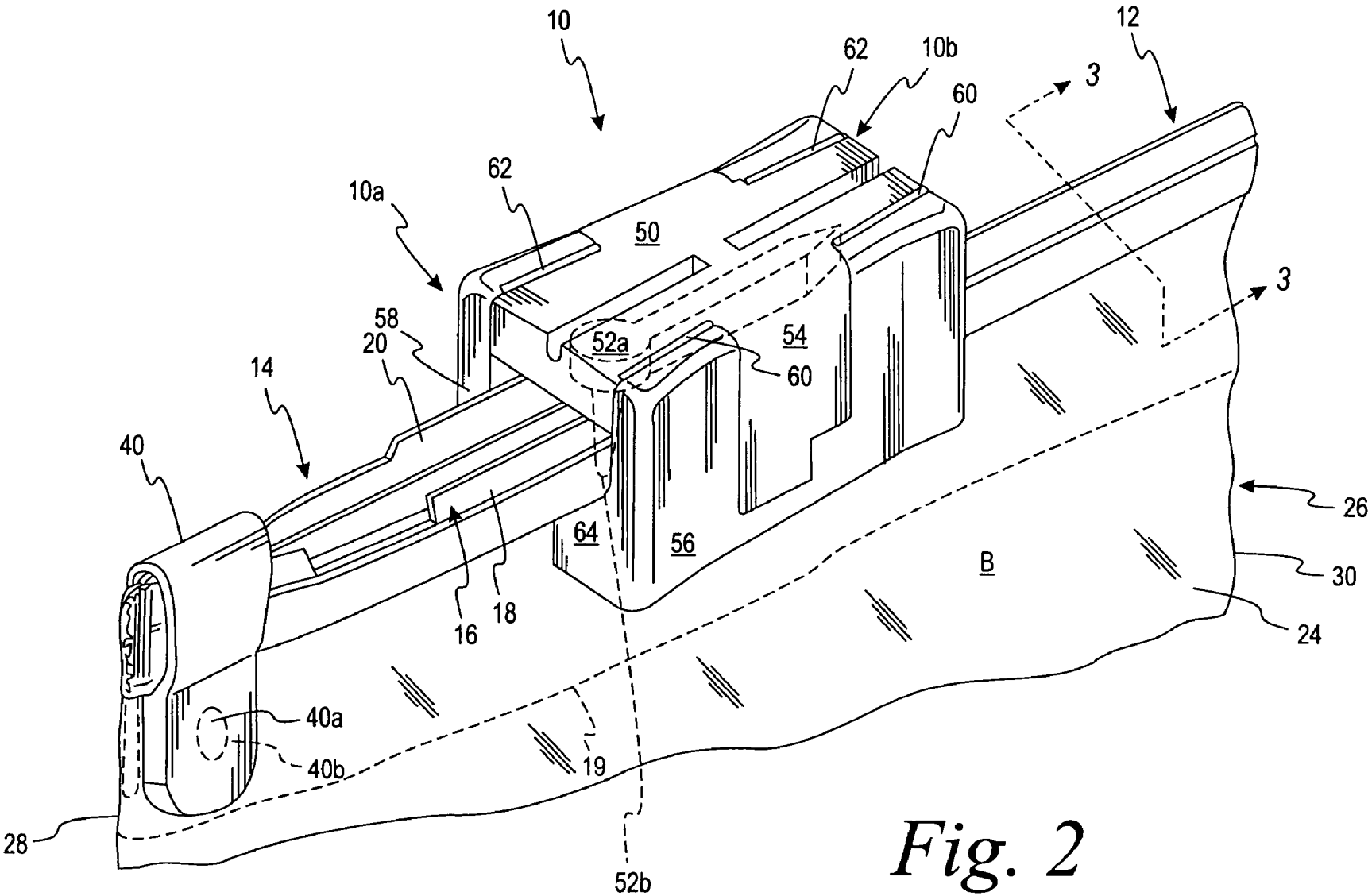
FIG. 2 is an enlarged perspective view of a slider on a bag constructed in accordance with one embodiment of the present invention.

Bag B (as shown in FIGS. 1 and 2) is formed from a single flexible polymeric sheet folded upon itself and comprises first and second opposing body panels 24, 26. Body panels 24, 26 are fixedly connected to each other along a pair of sides 28, 30 and a bottom 32 which extends between the pair of sides 28, 30. The fastener 12 extends along the top edge or mouth formed opposite the bottom 32 of bag B, in which the fastener 12 has a male track 14 and a female track 16.

Alternatively, bag B may be formed from separate polymeric sheets where the first and second opposing body panels are sealed after being initially separated so as to form the pair of sides and the bottom (i.e., sealed on three sides). Alternatively, bag B may be formed from a single flexible plastic sheet having a side fold, a seal on the side opposite the side fold, and an end seal (not shown).

Alternatively, bag B (not shown) may be a stand-up polymeric bag that comprises first and second opposing body panels, a bottom wall and a reclosable feature or fastener, such as a reclosable zipper which can be opened and closed either by the use of an auxiliary slider mechanism, by finger pressure, or by an auxiliary squeezing device other than an auxiliary slider mechanism. The first and second opposing body panels are coupled to opposing portions of the bottom wall. The bottom wall may be a gusseted bottom wall comprising gusseted portions or may be comprised of configurations other than a gusseted bottom wall. One example of a stand-up polymeric bag is shown in U.S. Pat. No. 6,148,588 to Thomas et al. It is contemplated that the bag may be a side-gusseted bag.

The body panels 24, 26 typically comprise one or more polymeric resins. The body panels 24, 26 may be comprised of polyolefins including, but not limited to, polyethylene, polypropylene or combinations thereof.

Figure 3:
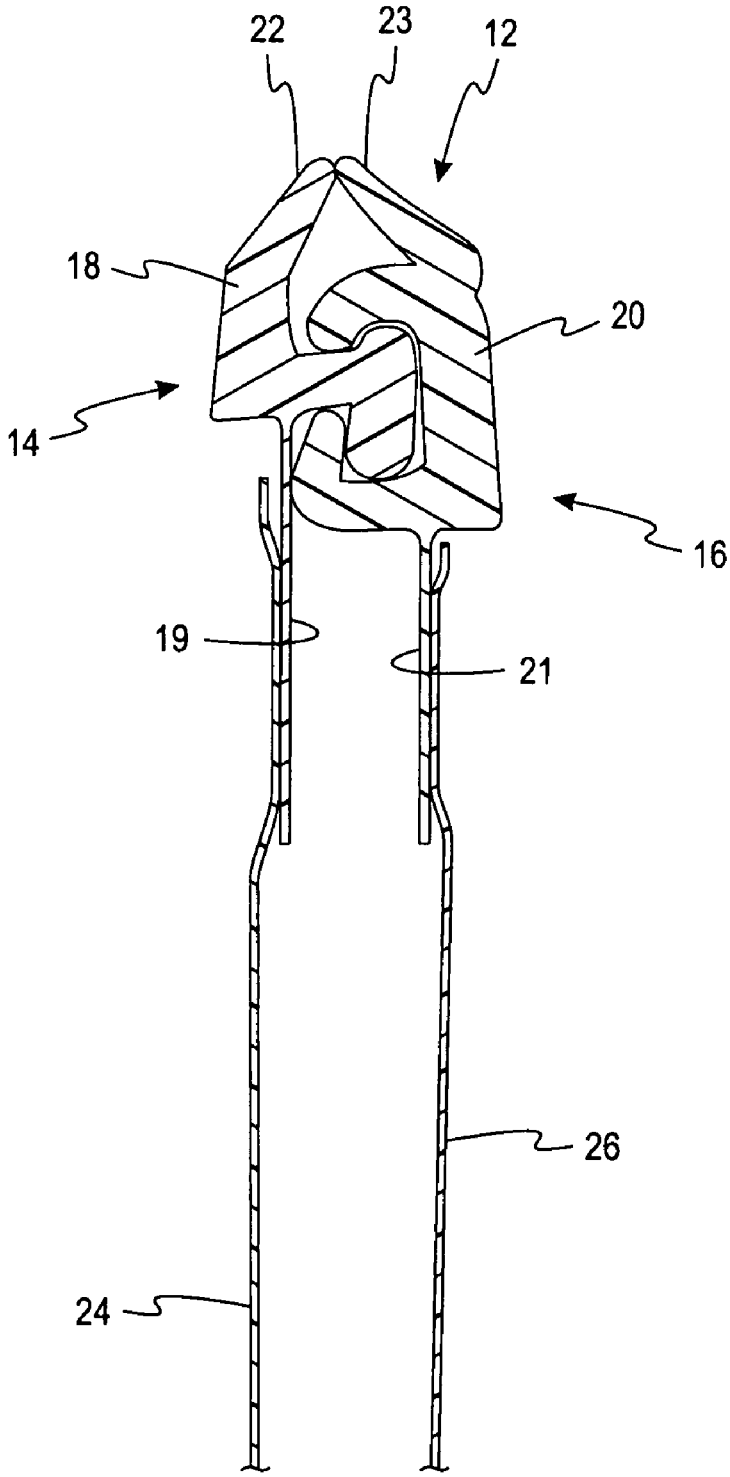
FIG. 3 is a cross-sectional view of the fastener of FIGS. 1 and 2 taken generally along line 3-3 in FIG. 2.

Referring to FIGS. 2 and 3, the fastener 12 comprises the male track 14 and the female track 16. The male and female tracks 14, 16 include respective male and female profiles 18, 20. The male and female profiles 18, 20 are interlocking and extend the length thereof in the form of rib and groove elements on the respective tracks. The tracks 14, 16 may be extruded separately with a fin and attached to the respective sides of the bag mouth or the tracks 14, 16 may be extruded integral with the sides of the bag mouth. If the tracks 14, 16 are extruded separately, they are most effectively attached by means of a respective male and female fins, incorporated within the tracks, that is heat sealed to a bag mouth.

The fastener 12 typically comprises one or more polymeric resins. The fastener may be comprised of polyolefins including, but not limited to, polyethylene, polypropylene or combinations thereof.

Referring specifically to FIG. 3, the male track 14 includes the male profile 18 and a first depending fin or flange 19, extending downward from the male profile 18. Likewise, the female track 16 includes the female profile 20 and a second depending fin or flange 21 extending downward from the female profile 20. The fins 19, 21 are shown attached to the opposing body panels 24, 26 in FIG. 3. The opposing body panels 24, 26 may be attached to the inner surfaces of respective fins 19, 21 as shown in FIG. 3 or may be attached to outer surfaces of respective fins 19, 21 (not shown). The male and female profiles 18, 20 have complementary cross-sectional shapes. The cross-sectional shapes of the interlocking male and female profiles 18, 20 shown in FIG. 3 are also shown in U.S. Pat. No. 5,007,143 to Herrington, which is incorporated herein by reference.

In the open position of the slider 10, the male and female profiles 18, 20 are disengaged from each other so that a user can gain access to the interior of the bag B. Movement of the slider 10 from the open position to the closed position interlocks the male and female profiles 18, 20 so as to restrict access to the interior of the bag B. For example, the male and female profiles 18, 20 may be rolled or pressed into their interlocking arrangement so as to securely close the bag B by one of two means. First, the tracks may be rolled or pressed together at one end by a user and then sequentially fitted together along the length of the fastener by a user running a finger along the length of the fastener on each side of the tracks. Alternatively, some bags employ a polymeric slider that rides along the tracks of the fastener. If the slider is pulled in one direction, the bag is sealed shut; if the slider is pulled in the opposite direction, the bag is reopened. As may be seen in FIG. 2, the slider 10 straddles the fastener 12 at the top of the bag B and is adapted for opening or closing the interlocking tracks 14, 16 of the fastener 12.

The opposite ends of the fastener 12 are typically provided with opposing end terminations. One example of an end termination is end termination clip 40 depicted in FIGS. 1-2. Each end clip 40 comprises a strap member which wraps over the top of the fastener 12. One end of the strap is provided with a rivet like member 40*a* which is adapted to penetrate through the bag material and into a cooperating opening 40*b* at the other end of the clip 40. The rivet 40*a* is then deformed so as to create a head locked into the opening 40*b*.

End terminations may have various purposes such as (a) preventing or inhibiting the slider 10 from going past the ends of the fastener 12, (b) interacting with the slider 10 to give a tactile indication of being closed, (c) assisting in inhibiting or preventing leakage from the bag B and (d) holding the male and female profiles 18, 20 together and providing additional strength in resisting stresses applied to the profiles 18, during normal use of the bag B. Further details concerning the construction and operation of the slider 10 and the end clips 40 may be obtained from U.S. Pat. No. 5,067,208 to Herrington, Jr. et al., which is incorporated herein by reference in its entirety.

It is contemplated that other end terminations may be used instead of the above-described end terminations clip 40. For example, an end weld may be formed by heated bars pressed against the end of the fastener, ultrasonic welding or other ways known in the art.

Improved Sliders

According to one embodiment of the present invention, a slider is adapted to remove packaged material, such as particles or powder, that has been trapped in an interior area of one or more of the tracks. The slider includes a slider finger that removes the packaged material that has been trapped in an interior area out of one or more of the profiles. The removal of the trapped material increases the likelihood of reclosing the pouch or bag (e.g., a stand-up bag).

Figure 4:
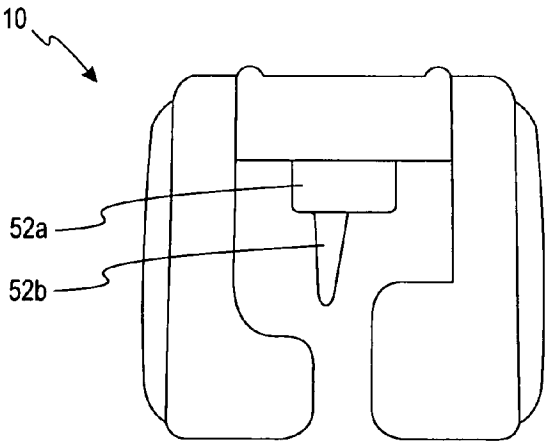
FIG. 4 is an end view of a slider with a generally straight finger according to one embodiment of the present invention.

Referring initially to FIG. 4, there is illustrated the slider 10 according to one embodiment of the present invention. The slider 10 may be a unitary or integral structure (i.e., a one-piece slider). The slider 10 is an inverted generally U-shaped member. The sliders of the present invention may be combined with the fastener or zipper 12 in forming the thermoplastic bag B (see FIGS. 1-2).

As shown in FIG. 2, the slider 10 comprises an inverted generally U-shaped member including a transverse support member or body 50 from which a torpedo 52*a* and generally straight slider finger 52*b* extend generally downward. The body 50 is itself U-shaped and includes two integral legs 54 extending generally downward. The generally straight finger 52*b* and torpedo 52*a* are positioned between the legs 54. It is contemplated the generally straight finger and torpedo may be located in front of the legs (i.e., at an end of the slider closer to end termination 40). The body 50 is adapted to move along the top edges of the tracks 14, 16 with the legs 54 straddling these elements and the torpedo 52*a* positioned between the tracks 14, 16. The slider 10 also includes a pair of hinged "wings" 56, 58 that can be folded down into their final position. The wings 56, 58 are hinged to the main slider body 50 by means of hinge structures 60, 62 located at opposite ends of the legs 54. It is contemplated that the slider does not necessarily have to be a hinged structure.

The foldable depending wings or side walls 56, 58 extend from an opening end 10*a* of the slider 10 to a closing end 10*b*. It is noted that the body 50 and the torpedo 52*a* are wider at the opening end 10*a* than at the closing end 10*b*. Similarly, the side walls 56, 58 and the legs 54 are spaced wider apart at the opening end 10*a* of the slider 10 to permit separation of the male and female profiles 18, 20 by the torpedo 52*a* engaging the tracks 14, 16. The wings 56, 58 and legs 54 are spaced sufficiently close together at the closing end 10*b* of the slider to press the male and female profiles 18, 20 into an interlocking relationship as the slider 10 is moved in a fastener closing direction.

As shown in FIG. 2, the wings 56, 58 at their lower ends are each provided with an inwardly extending shoulder structure 64. The shoulder structures 64 engage a bottom of the fastener 12 to prevent or inhibit the slider 10 from being lifted off the edges of the tracks 14, 16 while the slider 10 straddles the fastener 12. Specifically, the shoulder structures 64 engage with lower surfaces of the profiles to inhibit or prevent the slider from being (a) pulled off in a direction perpendicular to the sliding motion and (b) removed from the force required to open the profiles.

The torpedo 52*a* has a wide portion 53 (FIG. 5) and a narrow portion (not shown). The torpedo 52*a* with the wide and narrow portions interact with first and second portions 22, 23 (FIG. 5) of the fastener 12 to lock and unlock the male and female profiles 18, 20 of the fastener 12. This interaction opens and closes the fastener 12 in the manner described in U.S. Pat. No. 5,007,143 which is incorporated herein by reference in its entirety. More specifically, the wide portion 53 of the torpedo 52*a* in cooperation with the shoulder structures 64 spread the first and second portions 22, 23. The spread first and second portions 22, 23 separate the male and female profiles 18, 20, thereby opening the fastener 12 (FIG. 2) as the slider 10 is moved.

To close the fastener 12, the slider 10 is moved in the reverse direction and the narrow portion of the torpedo 52*a* cooperates with the shoulder structures 64 and the sides of the slider 10 to bring the first and second portions 22, 23 together. The first and second portions 22, 23 when brought together lock the male and female profiles 18, 20 (FIG. 3). To close the fastener 12 completely, at least the wide portion 53 of the torpedo 52*a* is removed from between the first and second portions 22, 23 of the fastener 12.

Referring to FIG. 4, it is desirable that the generally straight finger 52*b* is integrally connected to the torpedo 52*a*. For example, the slider 10 including the torpedo 52*a* and slider finger 52*b* may be formed by an injection molding process. The generally straight slider finger 52*b*, however, may be formed separately from the torpedo 52*a*.

Figure 5:
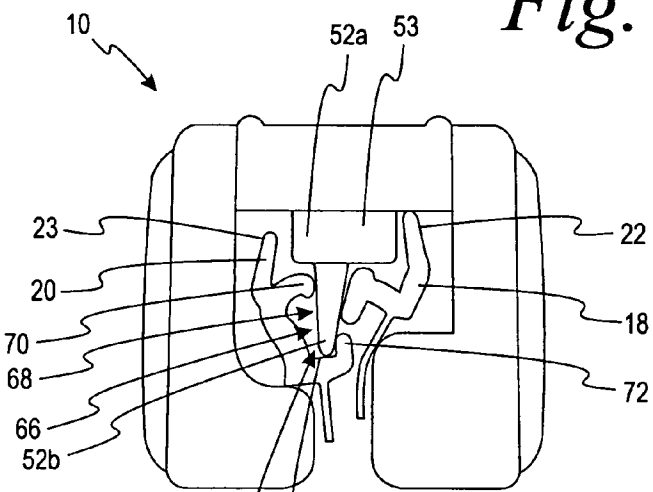
FIG. 5 is an end view of a the slider of FIG. 4 with first and second profiles according to one embodiment of the present invention.

The slider 10 with generally straight slider finger 52*b* is depicted in relation to the male profile 18 and the female profile 20 in FIG. 5. The generally straight slider finger 52*b* extends into and seats in an interior area 66 of the female profile 20. Specifically, the generally straight slider finger 52*b* extends through a female gap 68 formed between outer end extensions 70, 72 of the female profile 20. The generally straight slider finger 52*b* is shown in FIG. 5 as abutting a lower surface 74 of a groove 76 formed in the interior area 66. It is contemplated, however, that the generally straight slider finger 52*b* may not necessarily extend and abut the lower surface 74 of the groove 76 as long as the slider finger 52*b* assists in removing the material trapped in the interior area 66. For example, the generally straight slider finger 52*b* may extend to a location adjacent to or at an upper edge of the outer end extension 72 of FIG. 5. (see also FIG. 9). Preferably, the generally straight slider finger 52*b* assists in removing most, if not all, of the material, such as particles or powder, trapped in the female gap 68.

Figure 6:
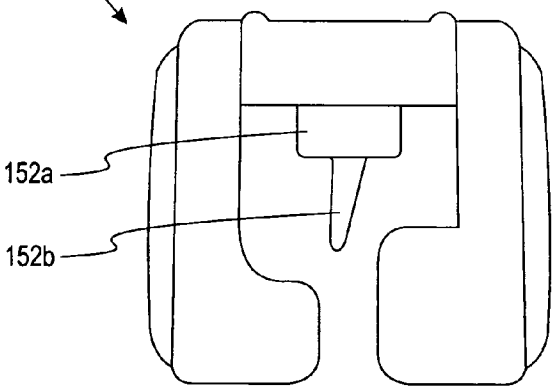
FIG. 6 is an end view of the slider with an angled finger according to another embodiment of the present invention.

According to another embodiment that is depicted in FIG. 6, a slider 110 has an angled slider finger 152*b*. The slider 110 includes the angled slider finger 152*b* and a torpedo 152*a*.

Figure 7:
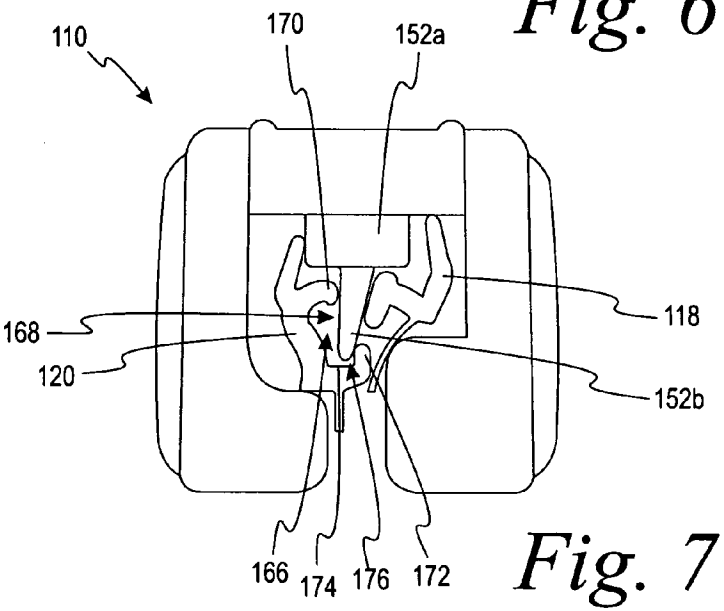
FIG. 7 is an end view of the slider of FIG. 6 with first and second profiles according to another embodiment of the present invention.

The slider 110 with the angled slider finger 152*b* is shown with respect to a male profile 118 and a female profile 120 in FIG. 7. The angled slider finger 152*b* extends into and seats in an interior area 166 of the female profile 120. Specifically, the angled slider finger 152*b* extends through a female gap 168 formed between outer end extensions 170, 172. The angled slider finger 152*b* is shown in FIG. 7 as abutting a lower surface 174 of a groove 176 formed in the interior area 166 at an angle. It is contemplated, however, that the angled slider finger 152*b* may not necessarily extend and abut the lower surface 174 of the groove 176 as long as the angled slider finger 152*b* assists in removing the material trapped in the interior area 166. For example, the angled slider finger 152*b* may extend to a location adjacent to or at an upper edge of the outer end extension 172 of FIG. 7 (see also FIG. 9). Preferably, the angled slider finger 152*b* assists in removing most, if not all, of the material, such as particles or powder, trapped in the female gap 168.

Figure 8:
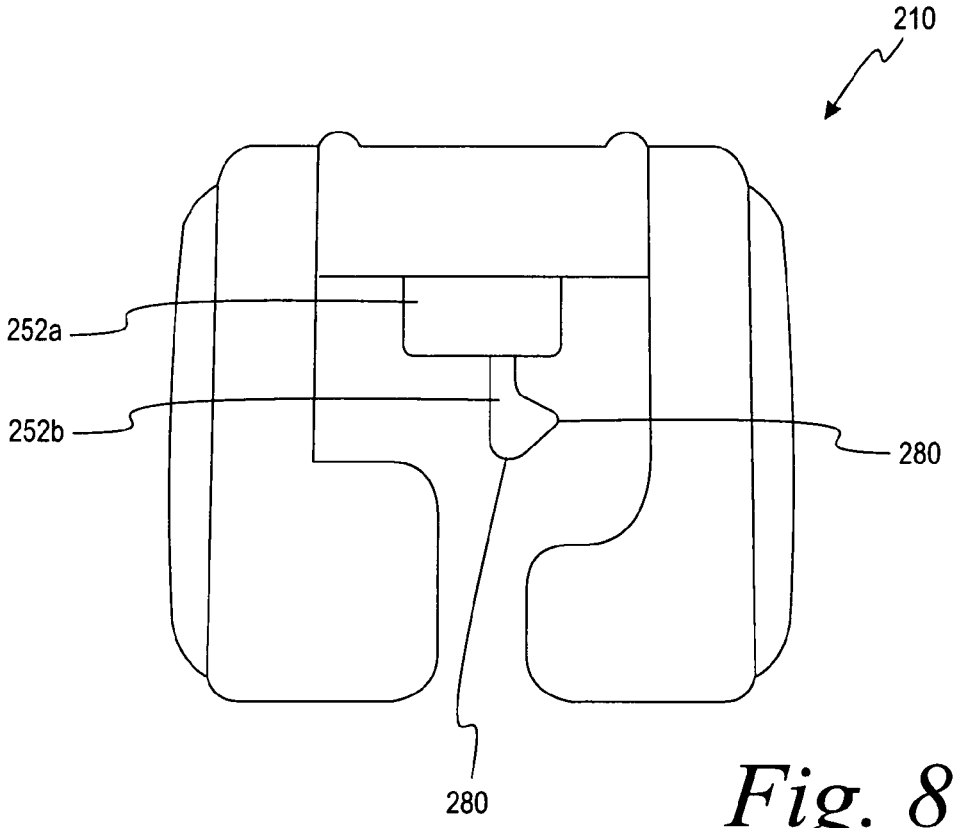
FIG. 8 is an end view of a slider with an enlarged radiused finger according to yet another embodiment of the present invention.
Figure 9:
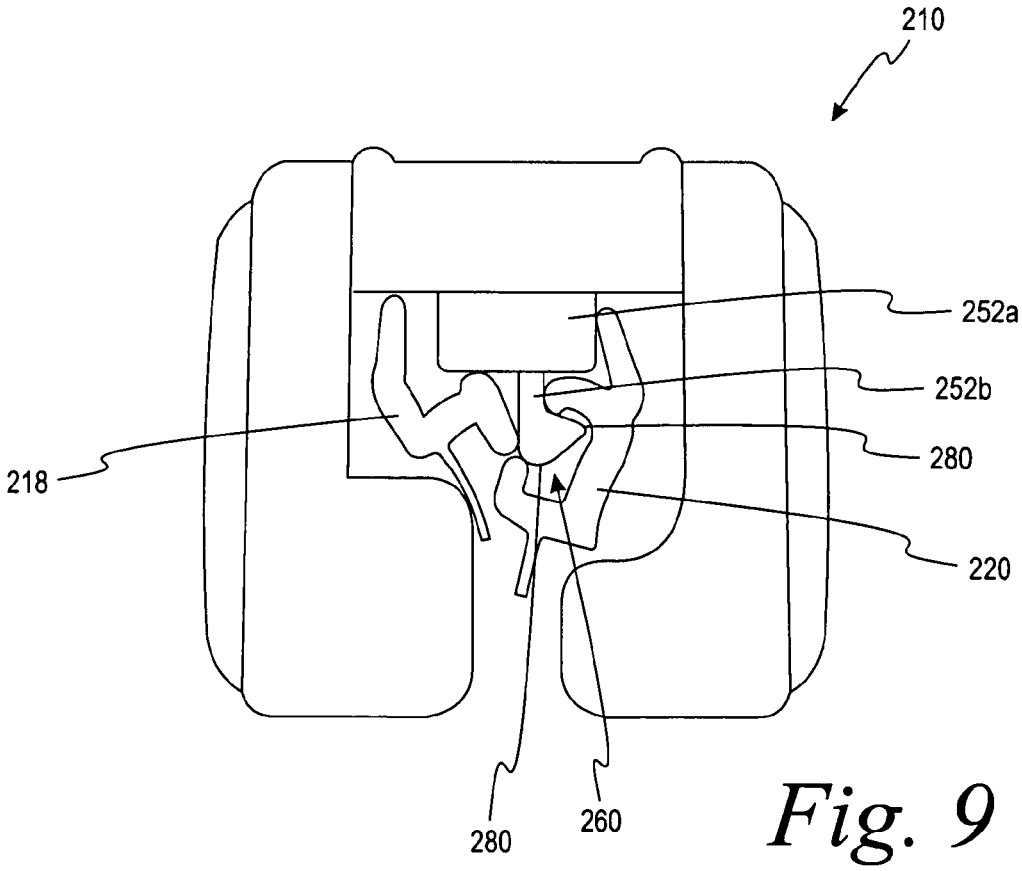
FIG. 9 is an end view of the slider of FIG. 8 with first and second profiles according to yet another embodiment of the present invention.

It is also contemplated that the generally straight slider finger 52*b* and the angled slider finger 152*b* may be sized and shaped differently than depicted in FIGS. 4-7. For example, in FIGS. 8-9, a slider 210 includes a torpedo 252*a* and a slider finger 252*b* that has been widened at one end to improve its strength while still assisting in removing material, such as particles or powder, from a female gap of the female profile 220. The slider finger 252*b* extends into an interior area 260 of the female profile 220. To reduce stress concentrations, edges 280 of the slider finger 252*b* of the slider 210 may be generally radiused as depicted in FIGS. 8 and 9. FIG. 9 depicts the relationship of the torpedo 252*a* and the slider finger 252*b* to the female profile 220 and male profile 218 in an open position.

Figure 11:
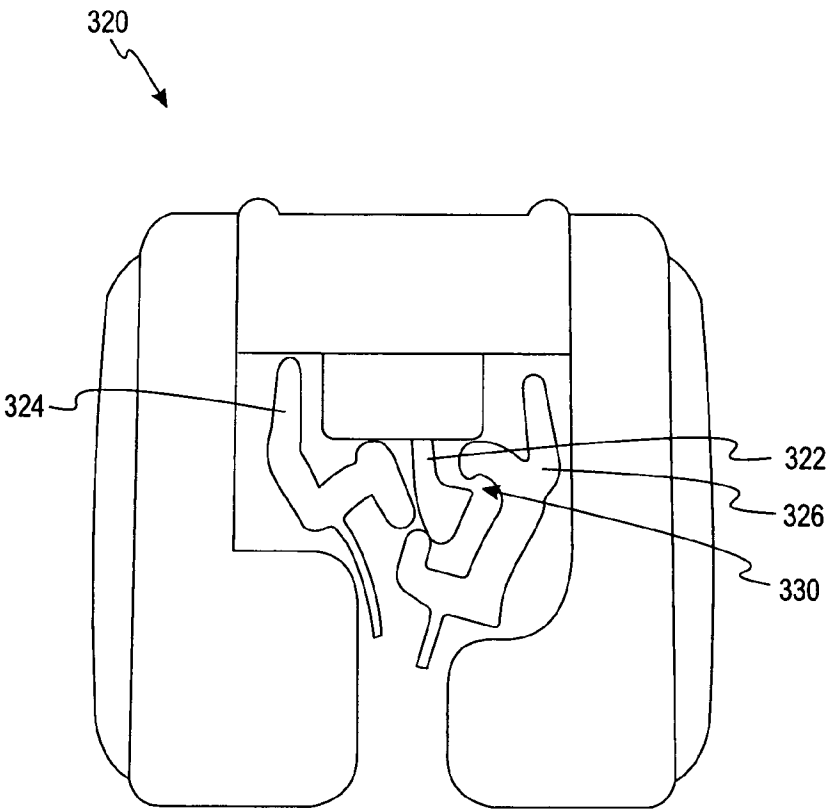
FIG. 11 is end view of a slider with a wider finger, and first and second profiles according to another embodiment of the present invention.
Figure 10:
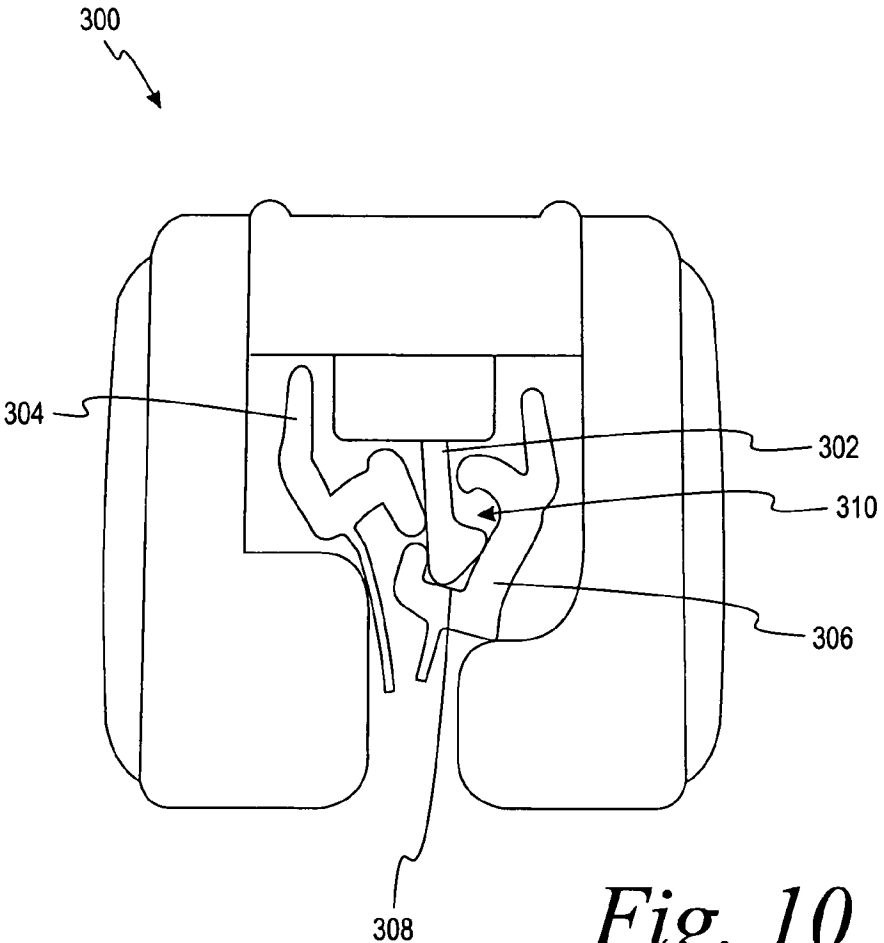
FIG. 10 is an end view of a slider with a longer finger, and first and second profiles according to an embodiment of the present invention.

Further examples of angled fingers are depicted in FIGS. 10 and 11. Referring to FIG. 10, a slider 300 is shown with a longer slider finger 302, as well as a male profile 304 and a female profile 306. The longer slider finger 302 extends and abuts a lower surface 308 of an interior area 310 of the female profile 306. Referring to FIG. 11, a slider 320 is shown with a wider slider finger 322, as well as a male profile 324 and a female profile 326. The wider slider finger 322 extends into an interior area 330 further than the angled slider 210 extends into the interior area 260 (FIG. 9).

According to one embodiment, a slider is adapted for use with a reclosable fastener for thermoplastic bags containing material. The reclosable fastener includes a first track and a second track. The first track includes a first profile, while the second track includes a second profile. The first and second profiles are releasably engageable to each other. At least one of the first and second profiles has an interior portion. The slider comprises a body that includes a top, a first side, a second side and a separation member on an underside of the top. The separation member is adapted to open and close the fastener and includes a slider finger that extends generally downwardly from the top. The slider finger extends into an interior portion of the first profile so as to assist in removing material trapped in the interior portion of the first profile when closing the reclosable fastener. The slider may be a unitary structure and may be an inverted generally U-shaped member. The slider finger may be generally straight or angled, and the slider finger may abut a lower surface formed in the interior area of the profile.

Figure 12:
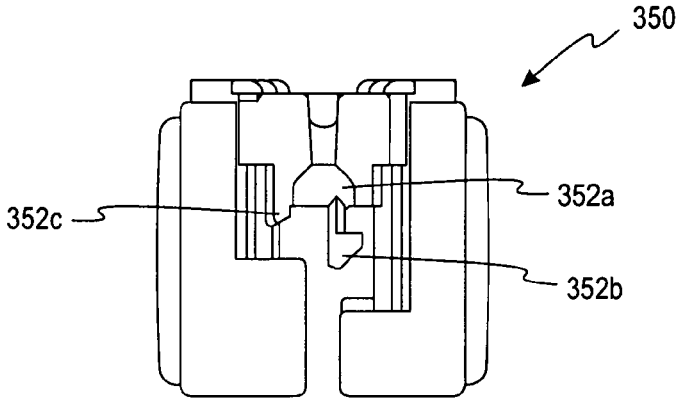
FIG. 12 is an end view of a slider according to yet another embodiment of the present invention.
Figure 13A:
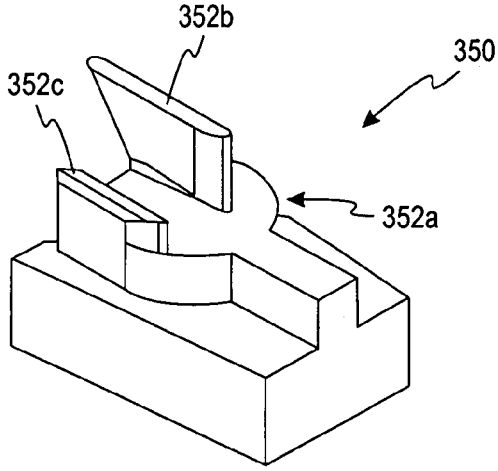
FIGS. 13*a, b* are perspective views of the slider of FIG. 12.
Figure 13B:
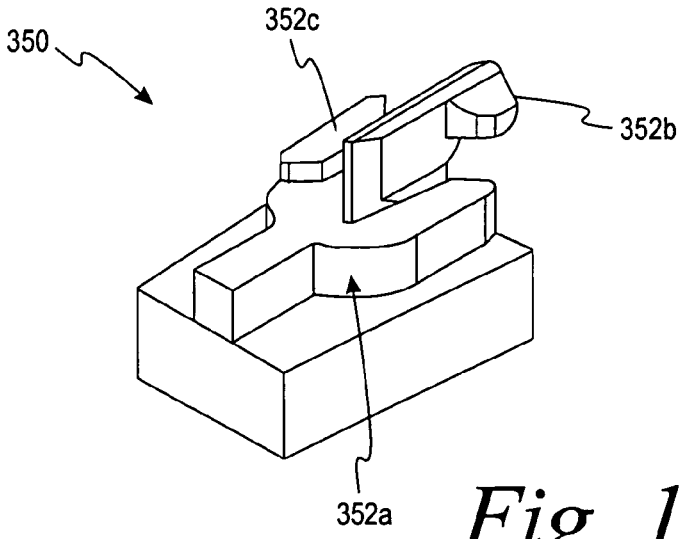

Another embodiment is depicted in FIGS. 12-15 with slider 350. Referring first to FIGS. 12-13*b*, the slider 350 includes a torpedo 352*a* with a first angled slider finger 352*b* and a second angled slider finger 352*c*. It is desirable for the first angled slider finger 352*b* and the second angled slider finger 352*c* to be integrally connected to the torpedo 352*a*.

Figure 14:
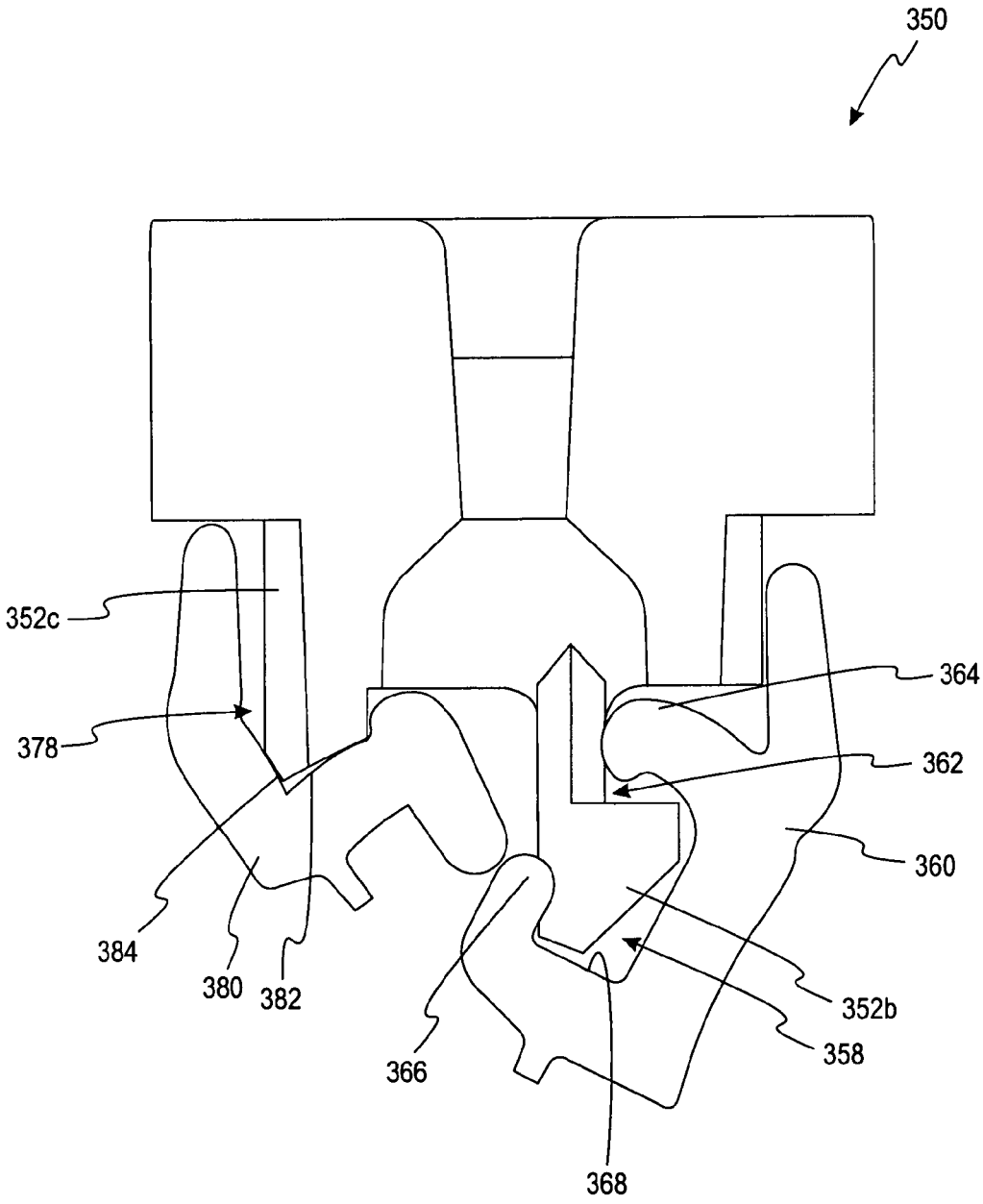
FIG. 14 is an end view of a portion of the slider of FIG. 12 with first and second profiles.
Figure 14A:
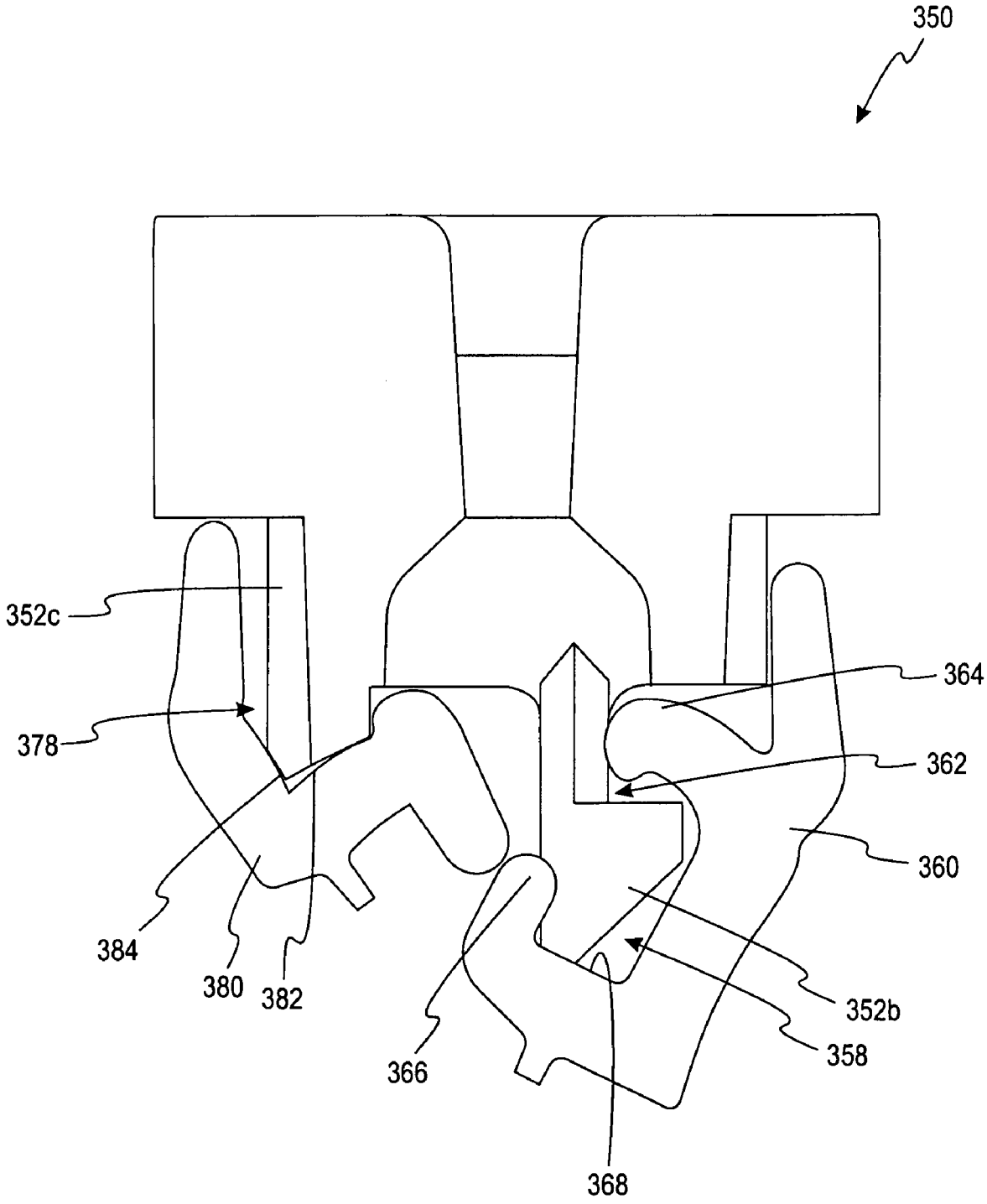
Figure 15:
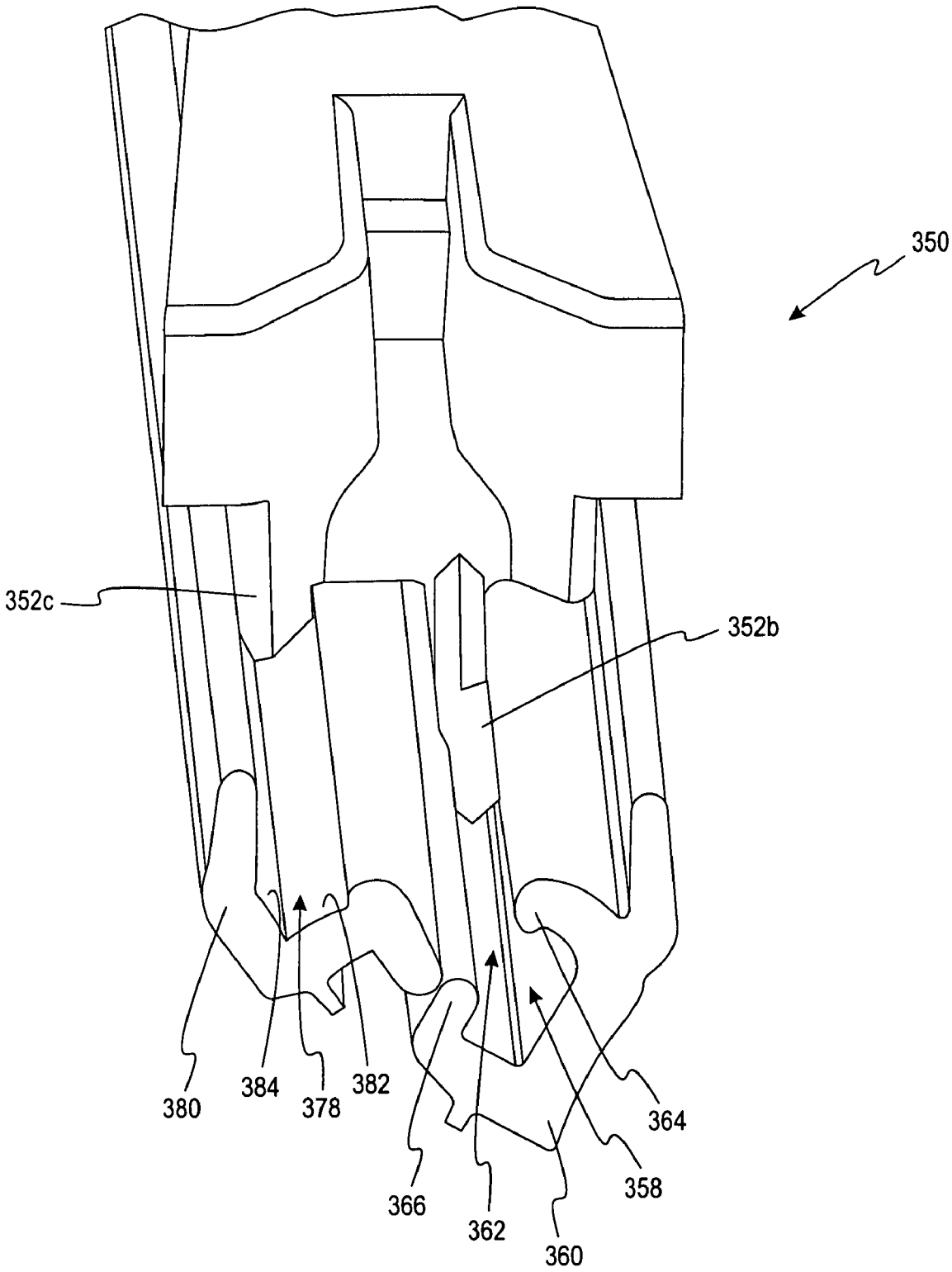
FIG. 15 is a top perspective view of a portion of the slider of FIG. 12 with first and second profiles.

As shown in FIGS. 14 and 15, the first angled slider finger 352*b* extends into an interior area 358 of a first profile 360, while the second angled slider finger 352*c* extends into an interior area 378 of a second profile 380. The first angled slider finger 352*b* extends through a female gap 362 formed between two extensions 364, 366 of the first profile 360. The first angled slider finger 352*b* assists in removing the material trapped in the interior area 358. The first angled slider finger 352*b* preferably assists in removing most, if not all, of the material, such as particles or powder trapped in the female gap 362. The first angled slider finger 352*b* is not shown in FIG. 14 as abutting a lower surface 368 of the first profile 360. It is contemplated that the first angled slider finger 352*b* could extend to and abut the lower surface 368.

The second angled slider finger 352*c* assists in removing the material trapped in the interior area 378 of the second profile 380. The second angled slider finger 352*c* is shown as abutting portions of surfaces 382, 384 of the second profile 380. It is contemplated that the second angled slider finger 352*c* may abut one or none of the surfaces 382, 384.

It is contemplated that one slider finger with two distinct extensions may be able to extend into an interior area of the first and second profiles so as to assist in removing the trapped material.

The sliders 10, 110 and 210 may be formed from suitable polymeric materials such as, for example, nylon, polypropylene, polyethylene, polystyrene, copolymers of polyethylene and polypropylene, polycarbonates, polyesters, polyacetals, acrylic-butadiene-styrene copolymers or combinations thereof. The sliders 10, 110 and 210 of the present invention may be formed by injection molding.

Elastomeric Profiles

According to another embodiment of the present invention, one or more of the profiles is designed to (a) expel material, such as particles or powder, that has been trapped, and/or (b) prevent or inhibit material from entering an interior area of the profile(s). One or more of the profiles uses a generally thin piece of elastic material to expel the material and/or prevent or inhibit material from entering an interior area of the profile(s).

According to this embodiment, a reclosable fastener is adapted for use with thermoplastic bags containing material. The reclosable fastener comprises a first track and a second track. The first track includes a first profile, while the second track includes a second profile. At least the first profile has an elastomeric portion attached thereto. The elastomeric portion is adapted to cover at least a portion of the first profile to prevent or inhibit the material from entering an interior area of the first profile and/or expel the material from the interior area of the first profile. The first and second profiles are releasably engageable to each other wherein the elastomeric portion is located between the first and second profiles during engagement thereto.

Figure 16:
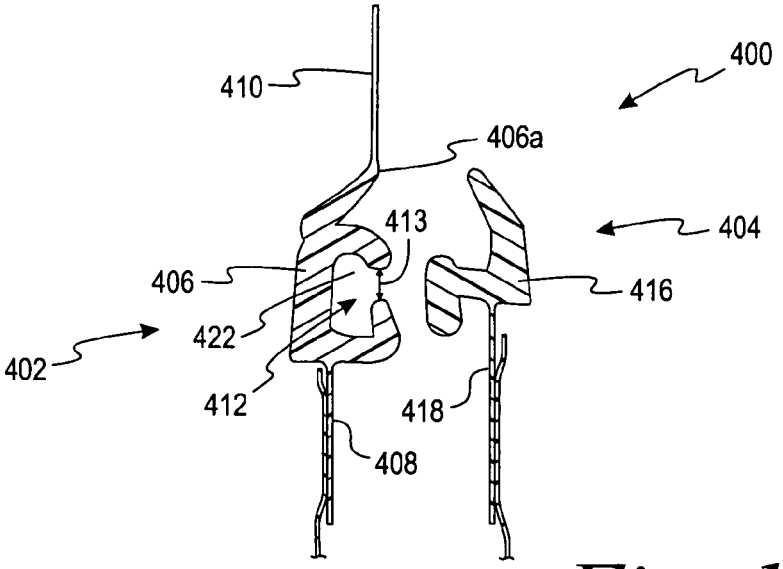
FIG. 16 is an elastomeric female track and a male track according to an embodiment of the present invention.
Figure 17:
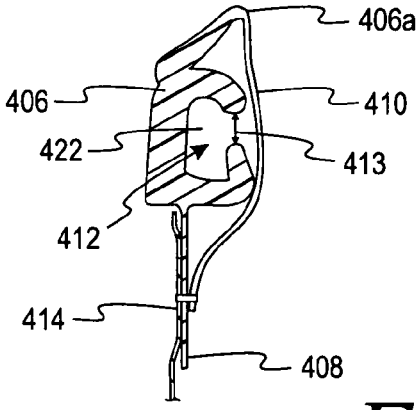
FIG. 17 is the elastomeric female track of FIG. 16 with an elastomeric profile portion in a first position.
Figure 18:
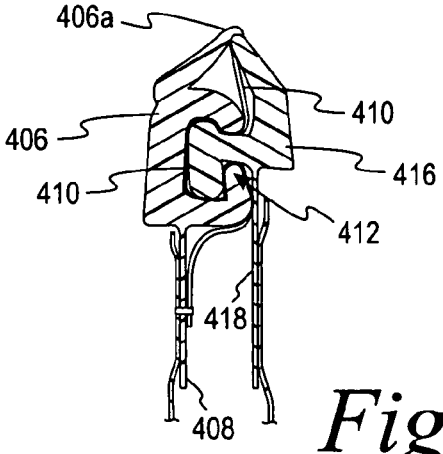
FIG. 18 is the elastomeric track and the male track of FIG. 16 in an interlocking position with the elastomeric profile portion in a second position.

Referring to FIGS. 16-18, one embodiment of an elastomeric track of the present invention is depicted. Referring to FIG. 16, a fastener 400 includes a female track 402 and a male track 404. The female track 402 includes a female profile 406 and a female fin 408 and the male track 404 includes a male profile 416 and a male fin 418. The female profile 406 includes an elastomeric portion 410 and an interlocking profile 412. The elastomeric portion 410 is adapted to cover an opening to an interior cavity 422 as shown in FIGS. 16-17. The elastomeric portion 410 is attached or formed to an end 406*a* of the female profile 406 as depicted in, for example, FIG. 16. The elastomeric portion 410 may be attached or formed to the female profile 406 using a coextrusion process. It is contemplated that the elastomeric portion 410 may be attached to the female profile 406 using other methods known in the art.

Referring to FIG. 17, the elastomeric portion 410 is shown covering the opening to the interior cavity 422 and is sealed to the female fin 408. The seal between the elastomeric portion 410 and the female fin 408 may also include a seal to an opposing body panel 414 as shown in FIG. 17. It is contemplated that the elastomeric portion 410 may be directed attached to an opposing body panel 414.

Referring to FIGS. 17 and 18, the elastomeric portion 410 is able to move or retract into the interior cavity 422 formed by the interlocking portion 412 when the female profile 406 is interlocked with the male profile 416. Thus, the elastomeric portion 410 must be of a sufficient elasticity to allow the male profile 416 to enter into the interior cavity 422 and interlock with the female profile 406. When the female profile 406 and the male profile 416 are not engaged, the elastomeric portion 410 pops open or snaps back so as to remove any unwanted material such as depicted in FIG. 17. This movement of the elastomeric portion 410 is depicted by comparing a first position of the elastomeric portion 410 (see FIG. 17) and a second position of the elastomeric portion 410 (see FIG. 18). The elastomeric portion 410 in the first position (FIG. 17) prevents or inhibits the material from entering the interior cavity 422 (including the female gap 413) of the female profile 406.

The elastomeric portion 410 may be placed in a first position (see FIG. 17) during the conversion of the bag (i.e., when the track and bag are connected). The conversion of the bag may also include the addition of an optional slider and opposing end terminations. The elastomeric portion 410 fits into the interior cavity 422 of the female profile 406 under tension by the male profile 416. To better remove the trapped material, it is desirable that the elastomeric portion 410 extend through at least a female gap of the female profile 406.

The elastomeric portion 410 may be made of any suitable material that (a) moves during the process of interlocking the female and male profile 406, 416 and (b) retracts upon the disengaging of the female and male profiles 406, 416 to remove unwanted material from at least the female gap 413 of the interior cavity 422 of the female profile 406. Examples of materials that may be used in forming the elastomeric portion 410 include wrapping polymeric materials such as polyvinylidene chloride (e.g., SARAN™ Wrap), rubber, rubberlike materials and alkenyl aromatic polymers (e.g., polystyrene foam).

The thickness of the elastomeric portion 410 is typically thinner than the remainder of the female profile 406. The elastomeric portion 410 generally has a thickness of from about 0.2 to about 10 mils and, more specifically, from about 0.5 to about 6 mils.

The interlocking portion 412 of the first profile 406, the second profile 416 and the fin portions 408, 418 may be independently made of polymeric resins such as polyolefinic resins. Nonlimiting examples of polyolefinic resins which may be used include low density polyethylenes, linear low density polyethylenes, high density polyethylenes (HDPE), medium density polyethylenes (MDPE), polypropylenes, plastomers, elastomers, ethylene vinyl acetates (EVA), ethyl methacrylates, polymethylpentene copolymers, polyisobutylenes, polyolefin ionomers, or combinations thereof. It is contemplated that other polyolefinic resins may be used. The preferred polyolefinic resins are low density polyethylenes and linear low density polyethylenes.

Figure 19:
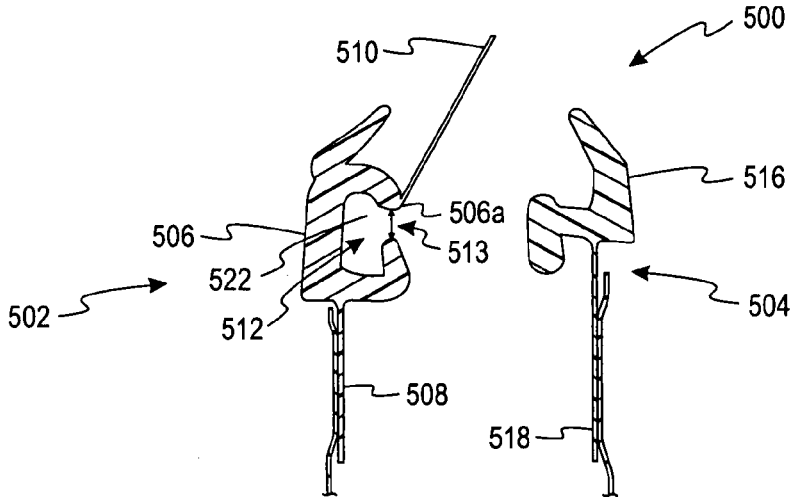
FIG. 19 is an elastomeric female track and a male track according to a further embodiment of the present invention.
Figure 20:
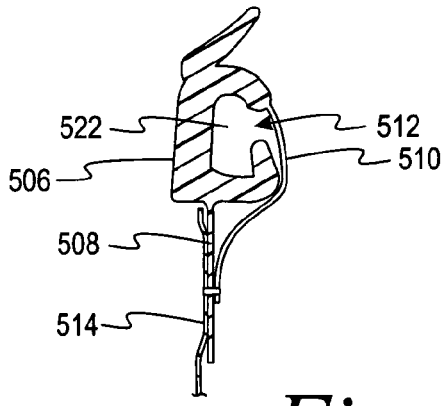
FIG. 20 is the elastomeric female track of FIG. 19 with an elastomeric profile portion in a first position.
Figure 21:
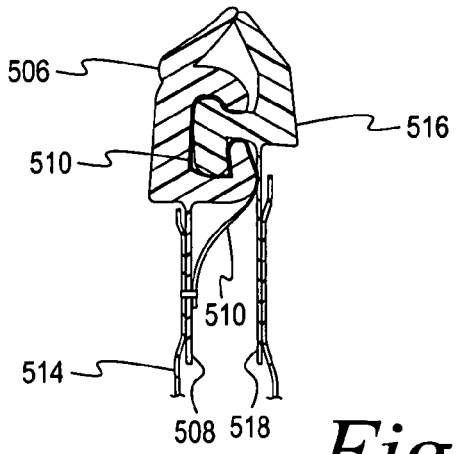
FIG. 21 is the elastomeric female track and the male track of FIG. 19 in an interlocking position with the elastomeric profile portion in a second position.

Referring to FIGS. 19-21, another embodiment using an elastomeric portion of the present invention is depicted. Referring to FIG. 19, a fastener 500 includes a female track 502 and a male track 504. The female track 502 includes a female profile 506 and a female fin 508 and the male track 504 includes a male profile 516 and a male fin 518. The female profile 506 includes an elastomeric portion 510 and an interlocking portion 512. The elastomeric portion 510 is adapted to cover an opening to an interior cavity 522 as shown in FIGS. 19-20. The elastomeric portion 510 is attached or formed in a different location of the female profile 506 than previously depicted in FIGS. 16-18 with respect to the elastomeric portion 410 and the female profile 406. Specifically, the elastomeric portion 510 is attached or formed to an end 506*a* of the female profile 506 where the end 506*a* forms a portion of female gap 513.

It is contemplated that the elastomeric portion may be attached to the interlocking portion at different locations than depicted in FIGS. 16-21. For example, the elastomeric portion may be attached to a portion of the interlocking portion 412 forming the interior cavity 422.

Referring to FIG. 20, the elastomeric portion 510 is shown covering the opening to the interior cavity 522 and is sealed to the female fin 508. The seal between the elastomeric portion 510 and the female fin 508 may also include a seal to an opposing body panel 514 as shown in FIG. 20. It is contemplated that the elastomeric portion 510 may be directed attached to an opposing body panel 514.

Referring to FIGS. 20 and 21, the elastomeric portion 510 is able to move or retract into the interior cavity 522 formed by the interlocking portion 512 when the female profile 506 is interlocked with the male profile 516. Thus, the elastomeric portion 510 must be of a sufficient elasticity to allow the male profile 516 to enter into the interior cavity 522 and interlock with the female profile 506. When the female profile 506 and the male profile 516 are not engaged, the elastomeric portion 510 pops open or snaps back so as to remove any unwanted material such as depicted in FIG. 20. This movement of the elastomeric portion 510 is depicted by comparing a first position of the elastomeric portion 510 (see FIG. 20) and a second position of the elastomeric portion 510 (see FIG. 21). The elastomeric portion 510 in the first position (FIG. 20) prevents or inhibits the material from entering the interior cavity 522 (including the female gap 513) of the female profile 506.

The elastomeric portion 510 may be placed in a first position (see FIG. 20) during the conversion of the bag (i.e., when the track and bag are connected). The conversion of the bag may also include the addition of an optional slider and opposing end terminations. The elastomeric portion 510 fits into the interior cavity 522 of the female profile 506 under tension by the male profile 516. To better remove the trapped material, it is desirable that the elastomeric portion 510 extend through at least a female gap 513 of the female profile 506.

It is also contemplated that the elastomeric portion of the female profile may be used with different shaped female and/or male profiles, than those depicted in FIGS. 16-21.

The materials used to form the elastomeric portion 510 are the same as described above with respect to the elastomeric portion 410. Similarly, the materials used to form the interlocking portion 512 of the female profile 506, the male profile 516, and the fins 508, 518 are the same as described above to the interlocking portion 412, the male profile 416 and the fins 408, 418, respectively.

Fin Flap Fasteners

Figure 22A:
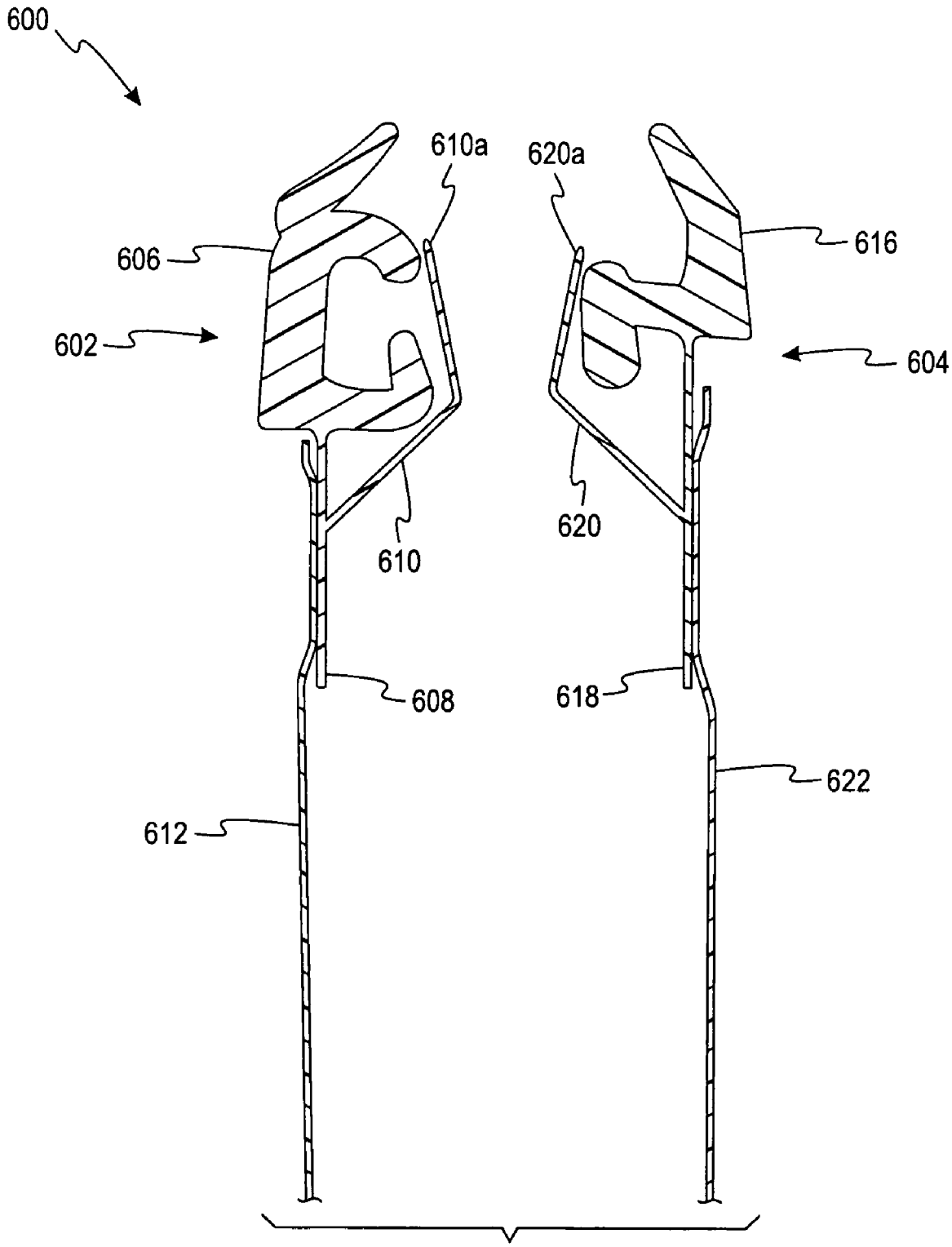
FIG. 22*a* is a female track and a male track with respective fin flaps according to one embodiment of the present invention.

Referring to FIG. 22*a*, a fastener 600 includes a female track 602 and a male track 604. The female track 602 includes a female profile 606 and a female fin 608, and the male track 604 includes a male profile 616 and a male fin 618. The female fin 608 and the male fin 618 include a female fin flap 610 and a male fin flap 620, respectively. The female fin 606 and the male fin 616 are attached to respective opposing body panels 612 and 622.

The female and male fin flaps 610, 620 are designed to prevent or inhibit material, such as particles or powder, from entering an interior area of the female profile 606 and/or male profile 616 during the pouring of the material from a pouch or bag. By reducing or eliminating material from entering the interior area of the female profile 606 and/or male profile 616, the likelihood of the entirely reclosing the profiles 606, 616 is increased.

The female fin flap 610 and the male fin flap 620 of FIG. 22*a* extend away from their respective fins 608, 618 in a generally upwardly and outwardly direction. Specifically, the female and male fin flaps 610, 620 extend generally toward the male and female profiles 606, 616. The female fin flap 610 and the male fin flap 620 extend away from the opposing body panels 612, 622. As shown in FIG. 22*a*, upper edges 610*a*, 620*a* of the male and female fin flaps 610, 620, respectively, are located near the respective profiles 606, 616 and also to each other so as to prevent or inhibit unwanted material from entering the interior areas of the profiles 606, 616.

The female fin flap 610 and the male fin flap 620 may be made of materials such as described above with respect to fins 408, 418. The female and male profiles 606, 616 may be made of materials such as discussed above with respect to male profile 416. Similarly, the female and male fins 608, 618 may be made of materials such as discussed above with respect to male and female fins 408, 418.

The female fin flap 610 and the male fin flap 620 may be integrally formed with the fins 608, 618, respectively. For example, the female fin 608 and the female fin flap 610 may be formed by profile extrusion. Similarly, the male fin 610 and the male fin flap 620 may be formed by profile extrusion or injection molding. Alternatively, the female fin 608 and the female fin flap 610 may be formed by coextrusion or other methods know in the art. Alternatively, the male fin 610 and the male fin flap 620 may be formed by coextrusion or other methods know in the art. For example, the female fin flap 610 and the male fin flap 620 may be attached to respective fins 608, 618 via an adhesive.

It is contemplated that the female and male fin flaps may be shaped differently and/or extend at different angles than depicted in FIG. 22*a*. The female and male fin flaps may extend from a different location on the respective fins than depicted in FIG. 22*a*. The fin flaps are not limited to the specific female and male profiles 606, 616 depicted in FIG. 22*a*.

Figure 22B:
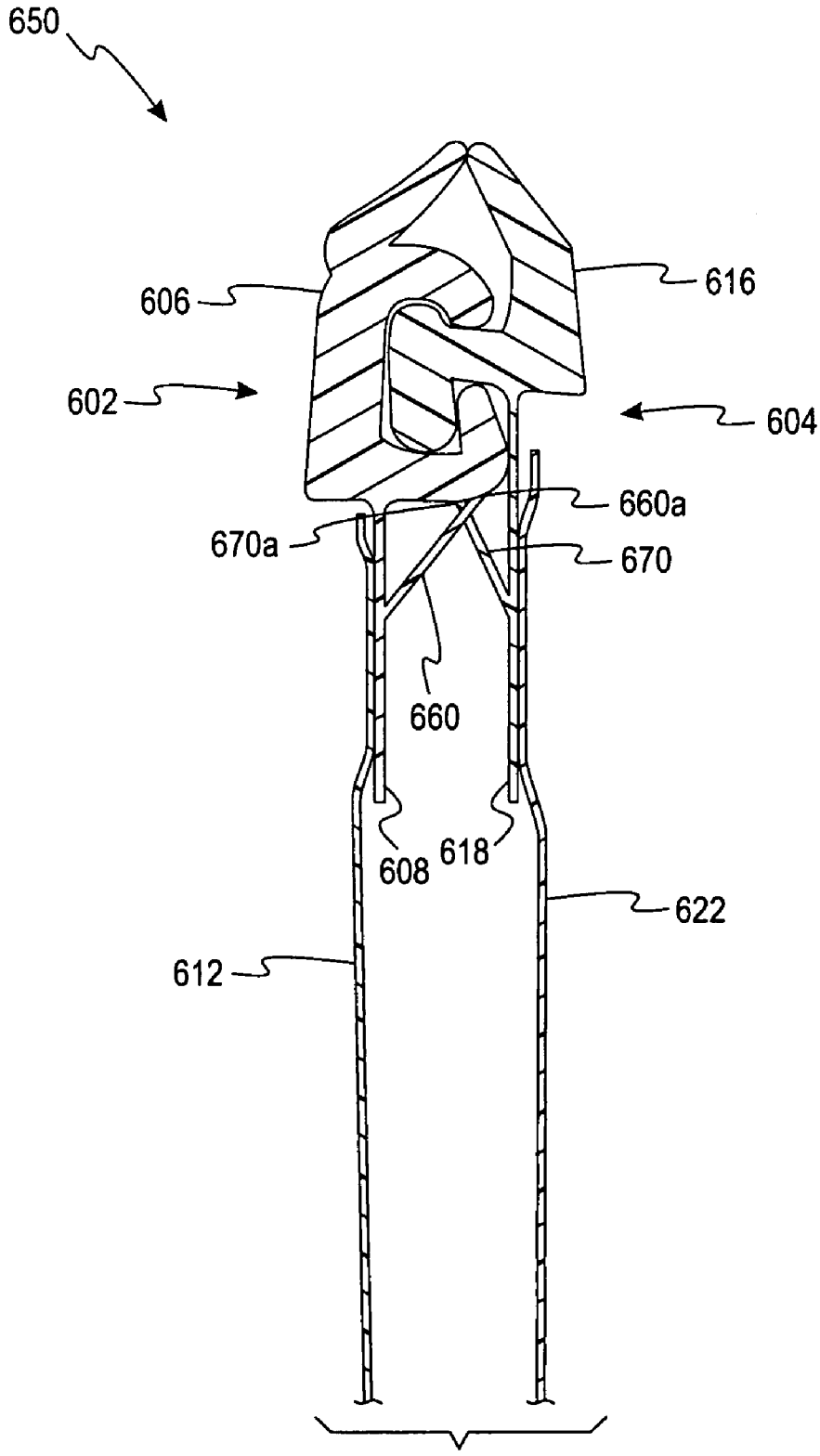
FIG. 22*b* is a female track and a male track with respective fin flaps according to another embodiment of the present invention.

For example, in FIG. 22*b*, a fastener 650 includes the female track 602 and the male track 604 and is shown in a non-interlocked position. The female track 602 includes the female profile 606 and the female fin 608, and the male track 604 includes the male profile 616 and the male fin 618. The female fin 608 and the male fin 618 include a female fin flap 660 and a male fin flap 670, respectively. The female fin 606 and the male fin 616 are attached to the respective opposing body panels 612 and 622. The female fin flap 660 has an end 660*a* that extends near to or above an interior cavity of the female profile 606. Similarly, the male fin flap 670 has an end 670*a* that extends near to or above an interlocking portion of the male profile 616.

Figure 22C:
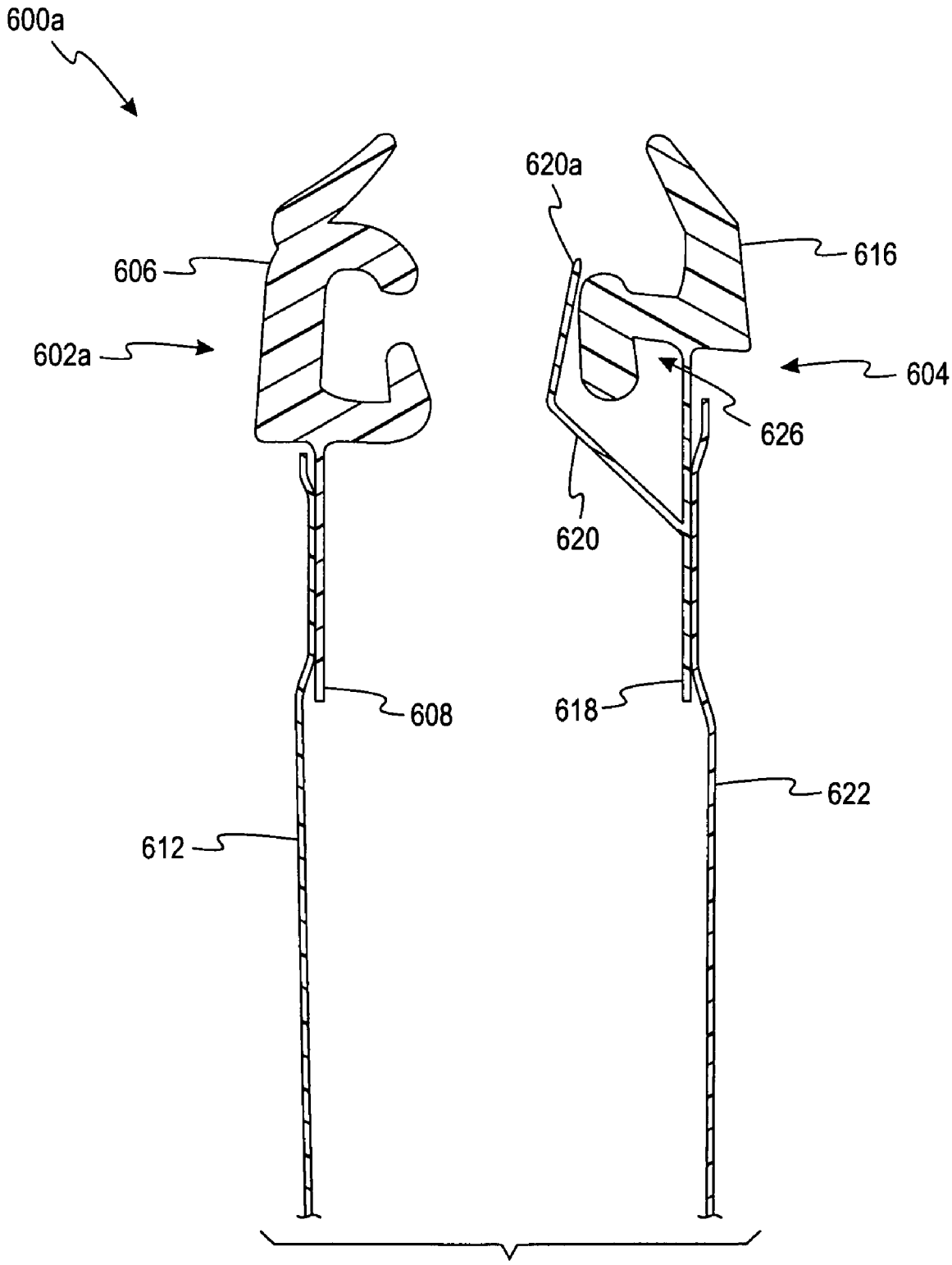
FIG. 22*c* is a female track and a male track with a fin flap according to another embodiment of the present invention.

It is also contemplated that the fin flap may be located on only one of the profiles. For example, in FIG. 22*c*, fastener 600*a* includes a female track 602*a* that includes the female profile 606 and the female fin 608, but does not include a female fin flap. The male track 604 of FIG. 22*c* includes the male fin flap 620 that prevents or inhibits material from entering the interior area of the male track 604 such as area 626. Alternatively, the fastener may include a female track that includes a female fin flap such as female track 602 of FIG. 22*a* and a male track that does not include a male fin flap.

Deflection Shield on Profile(s)

Figure 23:
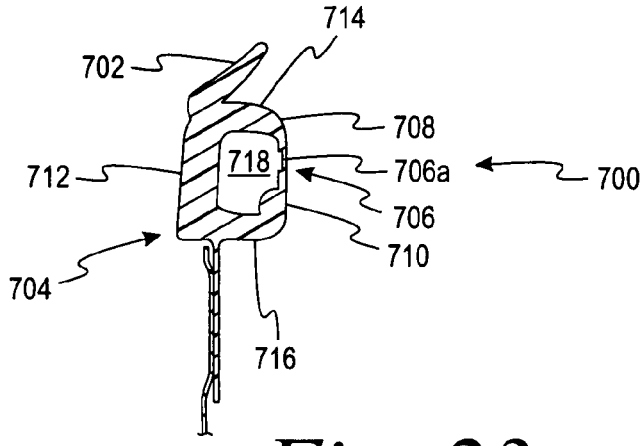
FIG. 23 is a female profile with a generally thin-walled section according to a further embodiment of the present invention.

Referring to FIG. 23, a female profile 700 is depicted that includes an extension portion or ear 702, a generally c-shaped section 704 and a generally thin-walled deflection shield 706. The thin-walled deflection shield 706 extends generally perpendicularly between outer ends 708, 710 of the generally c-shaped section 704. The ear 702 extends generally upwardly and outwardly from the generally c-shaped section 704 as depicted in FIG. 23.

The c-shaped section 704 includes a first portion 712 and two extensions 714, 716. The two extensions 714, 716 are generally perpendicular to and extend from the first portion 712. The two extensions 714, 716 are spaced apart from each other so as to form an interior area or cavity 718.

The thin-walled deflection shield 706 is designed to have at least a portion thereof (e.g., a seam portion) that enables a male profile to enter the interior area 718. The interior area 718 is adapted to receive a male profile (e.g., male profile 730 in FIG. 24) that interlocks with the female profile 700. The seam portion 706*a* of the deflection shield 706 is thinner than the remainder of the deflection shield 706 and is adapted to be broken, ruptured or slit by the male profile. The seam portion 706*a* is a stress point on the deflection shield 706 that is designed to break, rupture or slit before the remainder of the deflection shield 706. The seam portion 706*a* of the deflection shield 706 is preferably broken, ruptured or slit by the male profile during the closing of the track.

Figure 24:
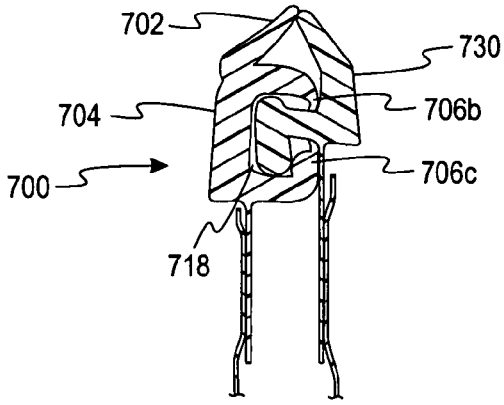
FIG. 24 is the female profile of FIG. 23 shown in an interlocking position with a male profile.

The interlocking relationship between the female profile 700 and the male profile 730 is depicted in FIG. 24. The male profile 730 enters the interior area 718 through the deflection shield 706 and, more specifically, the seam portion 706*a*.

Figure 25:
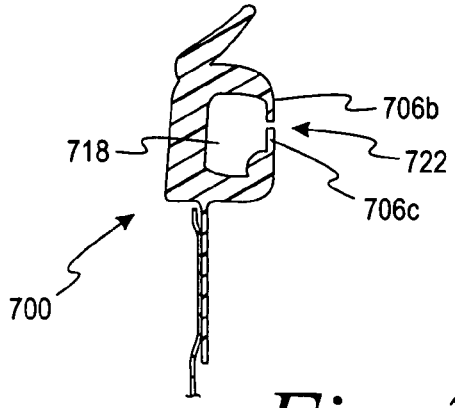
FIG. 25 is the female profile of FIG. 23 after the male profile has been in an interlocking position thereto.

Upon the disengagement of the female profile 700 and the male profile 730 (see FIG. 25), the deflection shield 706 is split into a first deflection shield 706*b* and a second deflection shield 706*c*. The first and second deflection shields 706*b*, 706*c* assist in preventing or inhibiting material, such as particles or powder, from entering the interior area 718 of the female profile 700. For example, the deflection shields 706*b*, 706*c* assist in preventing or inhibiting material, such as particles or powder, from entering a female gap 722. The female gap 722 of the female profile 700 is formed by the breaking, rupturing or slitting of the seam portion 706*a*.

The deflection shield 706 may be made from polymeric materials such as polyolefins, including polyethylenes, polypropylenes and combinations thereof. More specifically, the deflection shield 706 may be made of the materials discussed above in the fins 408, 418. The remainder of the female profile 700 (the ear 702 and the generally c-shaped section 704) may be formed by the same material as the deflection shield 706. It is contemplated, however, that the remainder of the female profile 700 may be formed from different materials than the deflection shield 706.

It is desirable that the deflection shields 706*b*, 706*c* have some flexibility to allow the male profile 730 to enter the female profile 700. The deflection shields 706*b*, 706*c* may have flexibility due to the thickness of the shields 706*b*, 706*c* and/or the materials used in forming the deflection shields 706*b*, 706*c*. This allows the first and second deflection shields 706*b*, 706*c* to be lengthened which assists in preventing or inhibiting more material from entering into or through the female gap 722. If the deflection shields 706*b*, 706*c* are not flexible, then the seam portion 706*a* must be sized to correspond with an interlocking portion of the male profile 730 that enters the interior area 718.

The first and second deflection shields 706*b*, 706*c* generally have a thickness of from about 0.5 to about 10 mils and more specifically, from about 2 to about 5 mils. The seam portion 706*a* is preferably thinner than the deflection shields 706*b*, 706*c*. The seam portion 706*a* generally has a thickness of from about 0.2 to about 8 mils and, more specifically, from about 1 to about 4 mils.

The female profile 700 with the deflection shield 706 may be formed by an extrusion process. The female profile 700 may be integrally formed. An air injection process is contemplated that will enhance the cooling time of the materials, especially the surfaces forming the interior area 718.

Alternatively, a female profile may comprise the first and second deflection shields 706*b*, 706*c* without the seam portion 706*a*. In other words, the female profile may initially have a small slit opening or gap (e.g., the female gap 722 of FIG. 25) formed between first and second deflection shields 706*b*, 706*c*. This of course would eliminate the need of a male profile from breaking, rupturing or slitting a portion of the thin-walled deflection shield 706.

Figure 26:
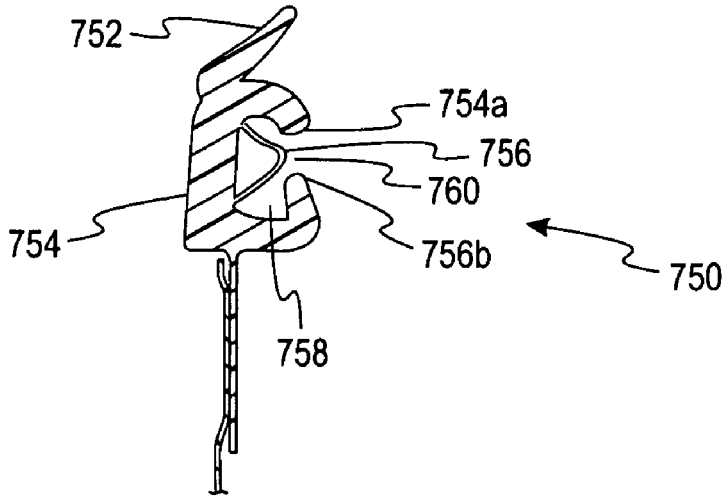
FIG. 26 is a female profile with a gasket portion according to yet a further embodiment of the present invention.
Figure 27:
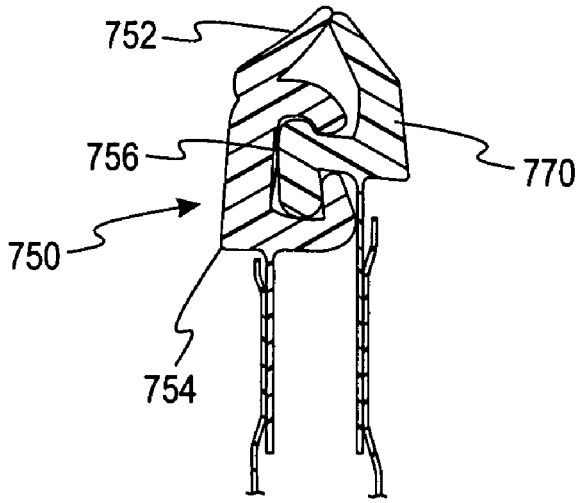
FIG. 27 is the female profile of FIG. 26 shown in an interlocking position with a male profile.

According to another embodiment depicted to FIGS. 26 and 27, a female profile 750 includes an extension portion or ear 752, a generally c-shaped section 754 and a gasket portion 756. The gasket portion 756 is located in an interior area or cavity 758 that is defined by an interior surface of the generally c-shaped section 754.

The gasket portion 756 assists in preventing or inhibiting materials, such as particles or powders, from entering the interior area 758 by deflecting such materials. The gasket portion 756 prevents or inhibits such material from entering the interior area 758 when the female profile 750 and male profile 770 (see FIG. 27) are not interlocked. The gasket portion also may expel material from the interior area 758 upon the disengagement of the female profile 750 and the male profile 770. The gasket portion 756 is shown as extending to or near a female gap 760. The female gap 760 is formed between ends 754*a*, 756*b* of the generally c-shaped section 754. When the female profile 750 and the male profile 770 are in an interlocking position (see FIG. 27), the gasket portion 756 is pushed back away from the female gap 760. After the female profile 750 and the male profile 770 are disengaged, the gasket portion 756 returns to or near its initial position depicted in FIG. 26.

The gasket portion 756 should be made of a generally resilient material so as to allow the gasket portion 756 to (a) compress in response to the process of interlocking the female profile 750 and the male profile 770 and (b) return to its initial position of FIG. 26 when the female profile 750 and the male profile 770 are not interlocked. The gasket portion 756 may be made of materials such as described above with respect to the male profile 416. The gasket portion 756 may have resiliency due to the thickness thereof. The remainder of the female profile 750 (ear 752 and generally c-shaped section 754) may be made of the same materials such as described above with male profile 416. It is contemplated that the remainder of the female profile 750 may be made of different materials than the gasket portion 756.

The female profile 750, including the gasket portion 756, may be formed from an extrusion process. It is contemplated that the female profile 750 with the gasket portion 756 may be formed by other methods known in the art, such as an injection molding process.

Track-In Track

According to yet another embodiment, a track-in-track feature is designed to prevent or inhibit materials, such as particles or powders, from entering an interior area of the female and male profiles. The track-in-track embodiment includes first male and female profiles being fit or engaged with second female and male profiles, respectively.

According to this embodiment, a reclosable fastener is adapted for use with thermoplastic bags having an interior space adapted to receive material. The reclosable fastener comprises a first male track, a second male track, a first female track, a second female track and a slider. The first and second male track includes a respective first and second male profile. The first and second female track includes a respective first and second female profile. The second male and female profiles are attached to the slider and when the slider is moved to an open position, the second male and female profiles engage with a respective first female and first male profiles so as to prevent or inhibit material from entering the interior first female and male profiles. When the slider is moved to a closed position, the second male and female profiles disengage with a respective first female and first male profiles.

Figure 28:
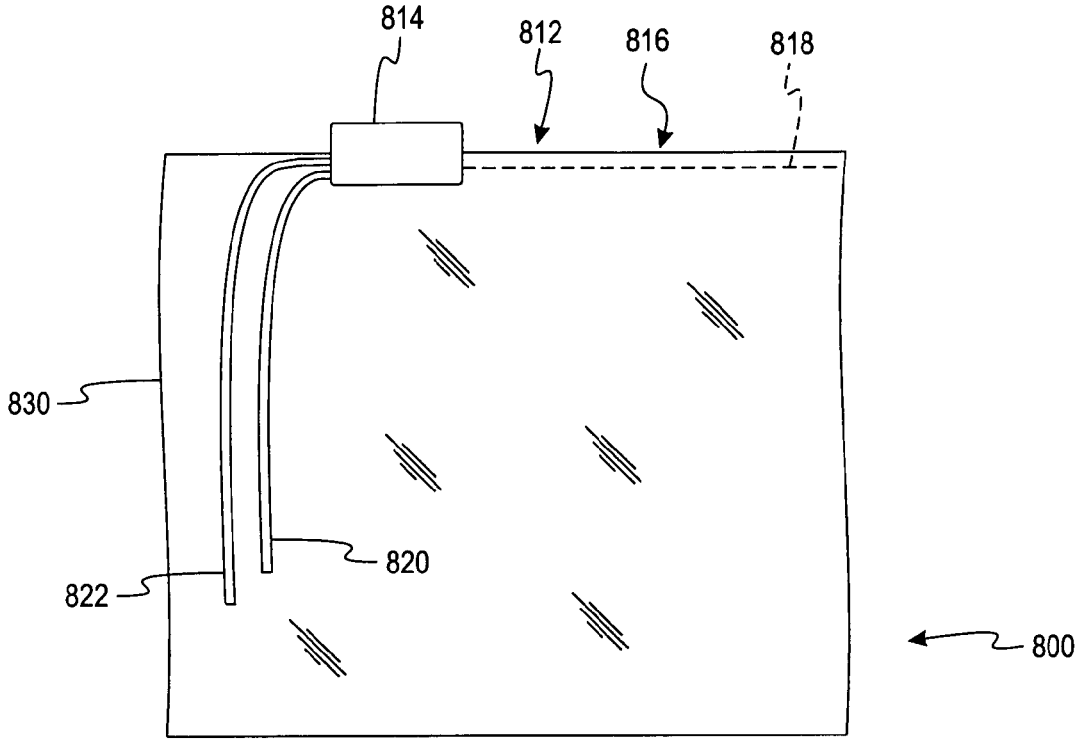
FIG. 28 is a side view of a polymeric bag and a fastener or zipper with two male profiles and two female profiles according to an embodiment of the present invention.

Referring to FIG. 28, a polymeric bag 800 is depicted with a fastener 812. The fastener 812 comprises a slider 814, a first female profile 816, a first male profile 818, a second female profile 820 and a second male profile 822. The second female profile 820 and the second male profile 822 are attached to the slider 814. The profiles 820, 822 may be molded, for example, to the slider 814.

Figure 29:
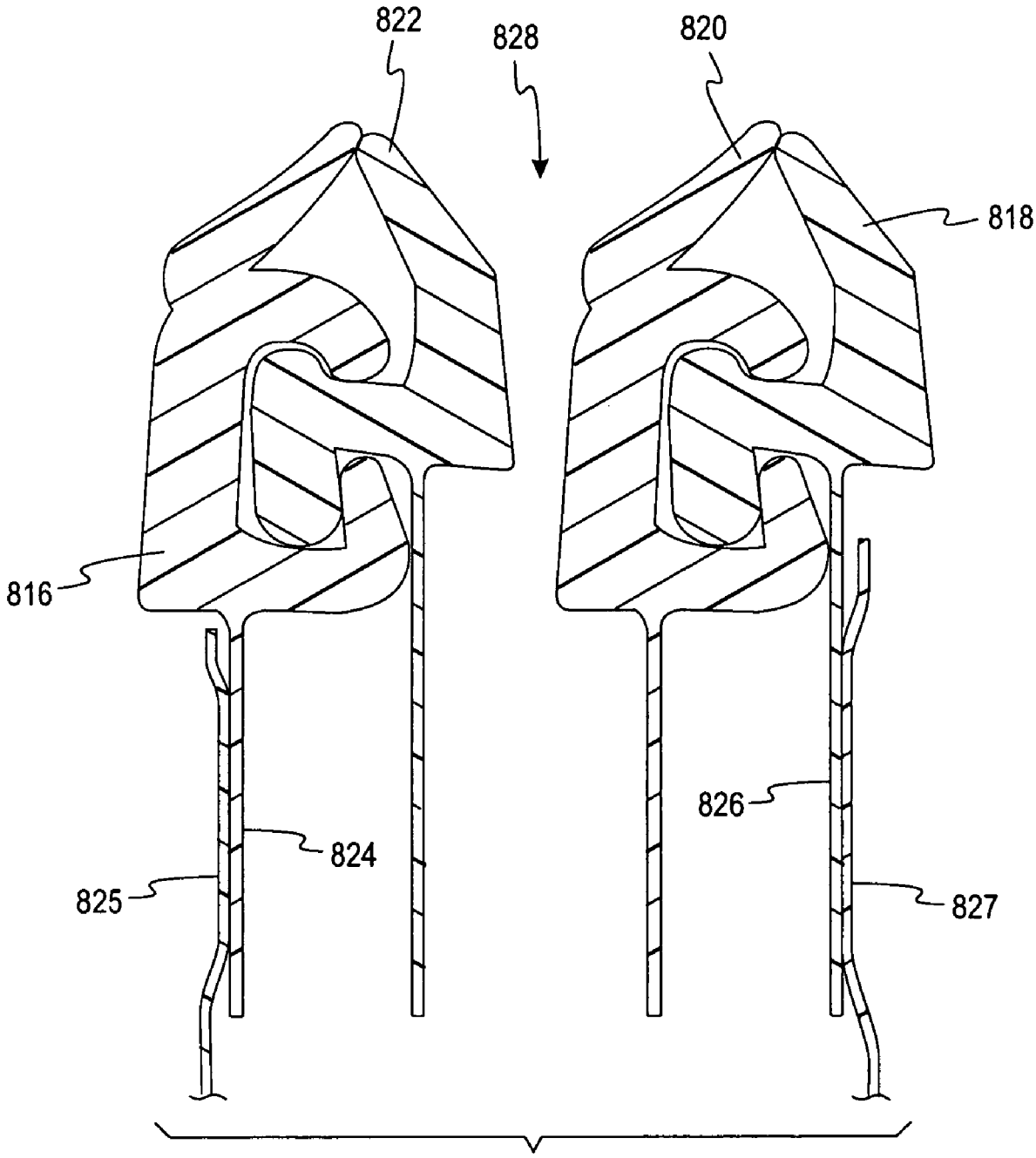
FIG. 29 is a cross sectional view of the respective male and female profiles of FIG. 28 in an interlocked position.

As the slider 814 is moved to an open position, the second female and male profiles 820, 822 slide forward and engage with respective first male profile 818 and first female profile 816. For example, a cross sectional of the profiles 816, 818, 820 and 822 is depicted in FIG. 29 where the cross sectional is taken across the profiles where the profiles 816, 818 are not engaged to each other (i.e., an open position). The profiles 816, 822 and 818, 820 in FIG. 29, however, are respectively interlocked to each other. The interlocked profiles 816, 822 and 818, 820 prevent or inhibit materials, such as particles or powders, from entering the tracks or profiles.

As depicted in FIG. 29, the profile 816 has a fin portion 824 extending generally downwardly therefrom. The fin portion 824 is attached to body panel 825. Similarly, the profile 818 has a fin portion 826 extending generally downwardly therefrom. The fin portion 826 is attached to body panel 827. When the profiles 816, 822 and 818, 820 are respectively engaged, material may still be poured from an area 828 between the profiles 820 and 822 as shown in FIG. 29. The area 828 may be increased by moving the engaged profiles 816, 822 and 818, 820 further apart from each other.

Figure 30:
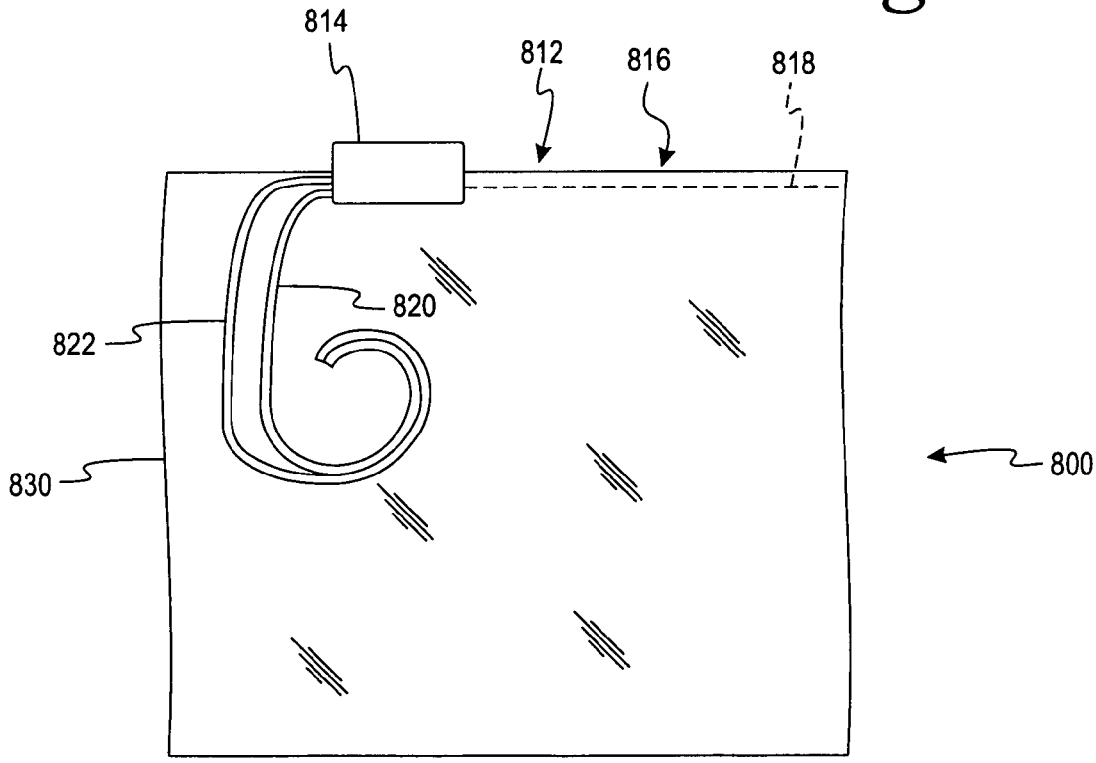
FIG. 30 is a side view of a polymeric bag and a fastener or zipper with two male profiles and two female profiles according to another embodiment of the present invention.

When the bag 800 is in a closed position, the first profiles 816, 818 are interlocked with each other and the second profiles 820, 822 extend into the bag region. The second profiles 820, 822 may extend in a generally downwardly direction into an interior of the bag 800 such as depicted in FIG. 28. The second profiles 820, 822 may extend into the interior of the bag 800 in a coiled manner such as depicted in FIG. 30. The second profiles 820, 822 may be formed with slip or antiblock additives so as to prevent or inhibit friction with a side 830 of the bag (see FIGS. 28 and 30) by improving the slip characteristics of the second profiles 820, 822. Contemplated slip additives include silicas, talcs, diatomaceous earth, silicates, lubricants, etc.

The first profiles 816, 818 and the second profiles 820, 822 may be independently formed from materials such as made of polymeric resins such as polyolefinic resins. Nonlimiting examples of polyolefinic resins which may be used include low density polyethylenes (LDPE), linear low density polyethylenes (LLDPE), high density polyethylenes (HDPE), medium density polyethylenes (MDPE), polypropylenes (PP), plastomers, elastomers, ethylene vinyl acetates (EVA), ethyl methacrylates, polymethylpentene copolymers, polyisobutylenes, polyolefin ionomers, or combinations thereof. It is contemplated that other polyolefinic resins may be used. The preferred polyolefinic resins are low density polyethylenes and linear low density polyethylenes.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A reclosable fastener for use with bags having an interior space adapted to receive material, the reclosable fastener comprising:

a first track comprising a first profile having an interior area, the first profile having a generally thin walled deflection shield that prevents or inhibits material from entering the interior area of the first profile; and a second track comprising a second profile, the first and second profiles being releasably engageable to each other by having a portion of the second profile enter the interior area of the first profile, wherein a portion of the generally thin walled deflection shield is adapted to break, rupture or slit in response to a portion of the second profile entering the interior area of the first profile.

2. The fastener of claim 1, wherein the generally thin walled deflection shield is formed by a seam portion.

3. The fastener of claim 2, wherein the seam portion is thinner than the remainder of the generally thin wall deflection shield.

4. The fastener of claim 1, wherein the first profile forms a general c-shape that includes at least two extensions having respective ends, the generally thin walled deflection shield attached to and extending between the respective ends.

5. The fastener of claim 4, wherein the generally thin walled deflection shield is perpendicular to the respective ends.

6. The fastener of claim 1, wherein the generally thin walled deflection shield upon breaking, rupturing or slitting in response to a portion of the second profile entering the interior area of the first profile forms two deflection shields.

7. The fastener of claim 1, wherein the first profile is integrally formed.

8. The fastener of claim 1, wherein the generally thin wall deflection shield is flexible.

9. The fastener of claim 1, wherein the generally thin wall deflection shield has a thickness of from about 0.5 to about 10 mils.

10. The fastener of claim 1, wherein the generally thin walled deflection shield is formed by a seam portion, the seam portion has a thickness of from about 0.2 to about 8 mils.

11. The fastener of claim 10, wherein the seam portion has a thickness of from about 1 to about 4 mils.

12. The fastener of claim 1, wherein the generally thin wall deflection shield comprises at least one polyolefin.

13. The fastener of claim 12, wherein the generally thin wall deflection shield comprises polyethylene, polypropylene, or combinations thereof.

14. A reclosable fastener for use with bags having an interior space adapted to receive material, the reclosable fastener comprising:

a first track comprising a first profile, the first profile being a general c-shape in the open position and further including two generally thin walled deflection shields, the general c-shape being formed from two extensions spaced apart and attached to a first portion, the two extensions having respective outer ends each spaced from the first portion, each of the two generally thin walled deflection shields being attached or formed near a respective one of the outer ends of the two extensions so as to prevent or inhibit material from entering the interior area of the first profile when the reclosable fastener is in an open position; and a second track comprising a second profile, the first and second profiles being releasably engageable to each other, wherein the generally thin walled deflection shields are spaced slightly apart so as to form a gap and to allow a portion of the second profile to enter into the interior area formed by the general c-shape section, and wherein the two generally thin walled deflection shields extend generally perpendicular from a respective one of the outer ends of the two extensions when the first and second profiles are not releasably engaged to each other, the two generally thin walled deflection shields being generally coplanar with each other when the first and second profiles are not releasably engaged to each other, wherein the thickness of the gap is substantially less than the thickness of the general c-shape section and wherein the thickness of the two generally thin walled deflection shields is substantially less than the thickness of the general c-shape section.

15. The fastener of claim 14, wherein each of the generally thin walled deflection shields is perpendicular to a respective end thereof when the first and second profiles are not releasably engaged to each other.

16. The fastener of claim 14, wherein the first profile is integrally formed.

17. The fastener of claim 14, wherein the generally thin wall deflection shields are flexible.

18. The fastener of claim 14, wherein the generally thin walled deflection shields have a thickness of from about 0.2 to about 10 mils.

19. The fastener of claim 14, wherein the generally thin wall deflection shields comprise at least one polyolefin.

20. The fastener of claim 19, wherein the generally thin wall deflection shields comprise polyethylene, polypropylene, or combinations thereof

21. A reclosable fastener for use with bags having an interior space adapted to receive material, the reclosable fastener comprising:

a first track comprising a first profile, the first profile being a general c-shape in the open position and further including two generally thin walled deflection shields, the general c-shape being formed from two extensions spaced apart and attached to a first portion, the two extensions having respective outer ends each spaced from the first portion, each of the two generally thin walled deflection shields being attached or formed near a respective one of the outer ends of the two extensions so as to prevent or inhibit material from entering the interior area of the first profile when the reclosable fastener is in an open position, the first track extending in a direction from one of the outer ends in an opposite direction from the interior area; and a second track comprising a second profile, the first and second profiles being releasably engageable to each other, the second track extending in a direction from the other one of the outer ends in an opposite direction from the interior area, wherein the generally thin walled deflection shields are spaced slightly apart so as to form a gap and to allow a portion of the second profile to enter into the interior area formed by the general c-shape section, and wherein the two generally thin walled deflection shields extend generally perpendicular from a respective one of the outer ends of the two extensions when the first and second profiles are not releasably engaged to each other, the two generally thin walled deflection shields being generally coplanar with each other when the first and second profiles are not releasably engaged to each other, wherein the thickness of the gap is less than the thickness of the general c-shape section and wherein the thickness of the two generally thin walled deflection shields is substantially less than the thickness of the general c-shape section.

* * * * *